US009044938B2

(12) United States Patent
Morita et al.

(10) Patent No.: US 9,044,938 B2
(45) Date of Patent: Jun. 2, 2015

(54) INKJET PRINTER

(71) Applicants: Kyoichi Morita, Anjo (JP); Hidenobu Kondo, Aichi (JP); Isao Kubo, Tokoname (JP); Takahiro Ikeno, Seto (JP)

(72) Inventors: Kyoichi Morita, Anjo (JP); Hidenobu Kondo, Aichi (JP); Isao Kubo, Tokoname (JP); Takahiro Ikeno, Seto (JP)

(73) Assignee: Brother Kogyo Kabushiki Kaisha, Nagoya, Aichi (JP)

( * ) Notice: Subject to any disclaimer, the term of this patent is extended or adjusted under 35 U.S.C. 154(b) by 0 days.

(21) Appl. No.: 13/852,258

(22) Filed: Mar. 28, 2013

(65) Prior Publication Data

US 2013/0271518 A1 Oct. 17, 2013

(30) Foreign Application Priority Data

Apr. 17, 2012 (JP) ..... 2012-093535

(51) Int. Cl.

| | |
|---|---|
| ***B41J 29/393*** | (2006.01) |
| ***B41J 2/07*** | (2006.01) |
| ***B41J 11/00*** | (2006.01) |
| ***B41J 19/20*** | (2006.01) |
| ***B41J 25/308*** | (2006.01) |

(52) U.S. Cl.
CPC *B41J 2/07* (2013.01); *B41J 11/005* (2013.01); *B41J 19/202* (2013.01); *B41J 25/308* (2013.01)

(58) Field of Classification Search
USPC ..... 347/5, 8, 9, 14, 19
See application file for complete search history.

(56) References Cited

U.S. PATENT DOCUMENTS

| | | | | |
|---|---|---|---|---|
| 6,092,939 | A | 7/2000 | Nishikori et al. | |
| 6,310,637 | B1 | 10/2001 | Shimada et al. | |
| 7,267,419 | B2 * | 9/2007 | Yamasaki | 347/19 |
| 2004/0126164 | A1 | 7/2004 | Ohyama | |
| 2008/0150978 | A1 | 6/2008 | Sato et al. | |
| 2009/0262157 | A1 | 10/2009 | Sato et al. | |
| 2012/0086747 | A1 | 4/2012 | Terada | |

FOREIGN PATENT DOCUMENTS

| | | | |
|---|---|---|---|
| JP | 2003-54078 | A | 2/2003 |
| JP | 2004-17586 | A | 1/2004 |
| JP | 2004-106978 | A | 4/2004 |
| JP | 3554184 | B2 | 8/2004 |
| JP | 2006-167995 | A1 | 6/2006 |
| JP | 2006-192814 | A | 7/2006 |
| JP | 2007-25492 | A | 2/2007 |
| JP | 2008-155423 | A | 7/2008 |
| JP | 2008-155424 | A | 7/2008 |
| JP | 2009-23121 | A | 2/2009 |
| JP | 2009-143152 | A | 7/2009 |
| JP | 2009-202430 | A | 9/2009 |
| JP | 2012-76429 | A1 | 4/2012 |
| JP | 2012-96378 | A1 | 5/2012 |

* cited by examiner

*Primary Examiner* — Lam S Nguyen
(74) *Attorney, Agent, or Firm* — Scully, Scott, Murphy & Presser, PC

(57) ABSTRACT

An inkjet printer is provided that includes a control device configured to determine an ink discharge moment when an inkjet head discharges an ink droplet from nozzles while moving within at least one of a acceleration range to accelerate the inkjet head and a deceleration range to decelerate the inkjet head, based on a distance between an ink discharge surface of the inkjet head and a recording sheet held in a predetermined wave shape and an amount of change in a moving velocity of the inkjet head.

17 Claims, 12 Drawing Sheets

S2
S2
S1
S1
HEIGHT OF SHEET
Ht1
Ht2
Hb2
Hb1

ΔT2
0

VELOCITY

R1
R2
R3
ΔT1
0

LEFT ⟷ RIGHT
SCANNING
DIRECTION

INKJET PRINTER

CROSS-REFERENCE TO RELATED APPLICATION

This application claims priority under 35 U.S.C. §119 from Japanese Patent Application No. 2012-093535 filed on Apr. 17, 2012. The entire subject matter of the application is incorporated herein by reference.

BACKGROUND

1. Technical Field

The following description relates to one or more techniques for an inkjet printer configured to perform printing by discharging ink droplets from nozzles onto a recording medium.

2. Related Art

As an example of inkjet printers that perform printing by discharging ink droplets from nozzles onto a recording medium, an inkjet printer has been known that is configured to perform printing by discharging ink droplets onto a recording sheet (a recording medium) from a recording head (an inkjet head) mounted on a carriage reciprocating along a predetermined scanning direction. Further, the known inkjet printer is configured to cause feed rollers and corrugated holding spur wheels to press the recording sheet against a surface of a platen that has thereon convex portions and concave portions alternately formed along the scanning direction, so as to hold the recording sheet in a predetermined wave shape. The predetermined wave shape has mountain portions protruding toward an ink discharge surface of the recording head, and valley portions recessed in a direction opposite to the direction toward the ink discharge surface, the mountain portions and the valley portions alternately arranged along the scanning direction. In other words, the recording sheet is corrugated in such a corrugated form as to have ridges and grooves (flutes) extending along a sheet feeding direction perpendicular to the predetermined scanning direction and alternating along the predetermined scanning direction.

SUMMARY

In the known inkjet printer, a gap (distance) between the ink discharge surface of the recording head and the recording sheet varies depending on portions (locations) on the recording sheet held in the wave shape (hereinafter, which may be referred to as a "wave-shaped recording sheet" or a "corrugated recording sheet"). Therefore, when the known inkjet printer performs printing by discharging ink droplets from the recording head onto the wave-shaped recording sheet with the same ink discharge timing as when performing printing on a recording sheet not held in such a wave shape (a recording sheet having a substantially uniform distance from the ink discharge surface all over the recording sheet), the ink droplets might land in positions deviated from their respective desired positions on the recording sheet. Thus, it might result in a low-quality printed image.

In the meantime, the known inkjet printer is configured to discharge ink droplets from the recording head while reciprocating the carriage. In the reciprocating movement, the carriage decelerates just before turning around its moving direction, and then accelerates in a direction opposite to the previous moving direction. The known inkjet printer may be configured to perform printing by discharging ink droplets from the recording head while accelerating or decelerating the carriage.

However, when the known inkjet printer discharges ink droplets from the recording head while accelerating or decelerating the carriage, the moving velocity of the carriage varies from one ink discharge moment to another. Therefore, when ink discharge timing is determined with no consideration for the change in the moving velocity of the carriage, it leads to positional deviations of the ink droplets landing on the recording sheet and thus to a low-quality printed image.

Aspects of the present invention are advantageous to provide one or more improved techniques for allowing an inkjet printer to land ink droplets in appropriate positions on a wave-shaped recoding sheet even when the inkjet printer performs printing by discharging the ink droplets from an inkjet head while accelerating or decelerating the inkjet head.

According to aspects of the present invention, an inkjet printer is provided that includes an inkjet head configured to discharge ink droplets from nozzles formed in an ink discharge surface thereof while reciprocating relative to a recording sheet along a scanning direction parallel to the ink discharge surface, a wave shape holding mechanism configured to hold the recording sheet in a predetermined wave shape that has top portions of portions protruding in a first direction toward the ink discharge surface and bottom portions of portions recessed in a second direction opposite to the first direction, the top portions and the bottom portions alternately arranged along the scanning direction, and a control device configured to control the inkjet head to move along the scanning direction and discharge the ink droplets from the nozzles, determine ink discharge moments to discharge the ink droplets from the nozzles while the inkjet head is moving within at least one of an acceleration range to accelerate the inkjet head and a deceleration range to decelerate the inkjet head, based on a distance between the ink discharge surface and the recording sheet held in the predetermined wave shape and a moving velocity of the inkjet head.

According to aspects of the present invention, further provided is an inkjet printer that includes an inkjet head configured to discharge ink droplets from nozzles formed in an ink discharge surface thereof while reciprocating relative to a recording sheet along a scanning direction parallel to the ink discharge surface, a wave shape holding mechanism configured to hold the recording sheet in a predetermined wave shape that has top portions of portions protruding in a first direction toward the ink discharge surface and bottom portions of portions recessed in a second direction opposite to the first direction, the top portions and the bottom portions alternately arranged along the scanning direction, and a control device configured to control the inkjet head to move along the scanning direction and discharge the ink droplets from the nozzles, and determine ink discharge timing to discharge an ink droplet from the nozzles while the inkjet head is moving within a predetermined printable range including at least one of an acceleration range to accelerate the inkjet head and a deceleration range to decelerate the inkjet head, based on a moving velocity of the inkjet head and a distance between the ink discharge surface and the recording sheet held in the predetermined wave shape, the distance determined depending on a position of the inkjet head in the scanning direction.

According to aspects of the present invention, further provided is an inkjet printer configured to form an image on a sheet, the inkjet printer including an inkjet head configured to discharge an ink droplet from an ink discharge surface thereof, a head moving mechanism configured to reciprocate the inkjet head in a predetermined printable range along a scanning direction, a detector configured to detect a position of the inkjet head in the scanning direction in the printable range, a sheet conveyor configured to convey the sheet in a sheet feeding direction perpendicular to the scanning direction and to corrugate the sheet in such a corrugated form that a flute of the corrugated sheet extends along the sheet feeding direction, and a control device configured to control the head moving mechanism to reciprocate the inkjet head in the printable range along the scanning direction, detect the position of the inkjet head in the scanning direction in the printable range, using the detector, determine a moving velocity of the inkjet head in the scanning direction in accordance with a detection result of the detector, determine a distance between the ink discharge surface and the corrugated sheet in accordance with the position of the inkjet head in the scanning direction and the predetermined corrugated form of the sheet, determine an ink discharge timing to discharge the ink droplet from the ink discharge surface in accordance with the moving velocity of the inkjet head in the scanning direction and the distance between the ink discharge surface and the corrugated sheet, and control the inkjet head to discharge the ink droplet at the determined ink discharge timing.

BRIEF DESCRIPTION OF THE ACCOMPANYING DRAWINGS

Figure 1:
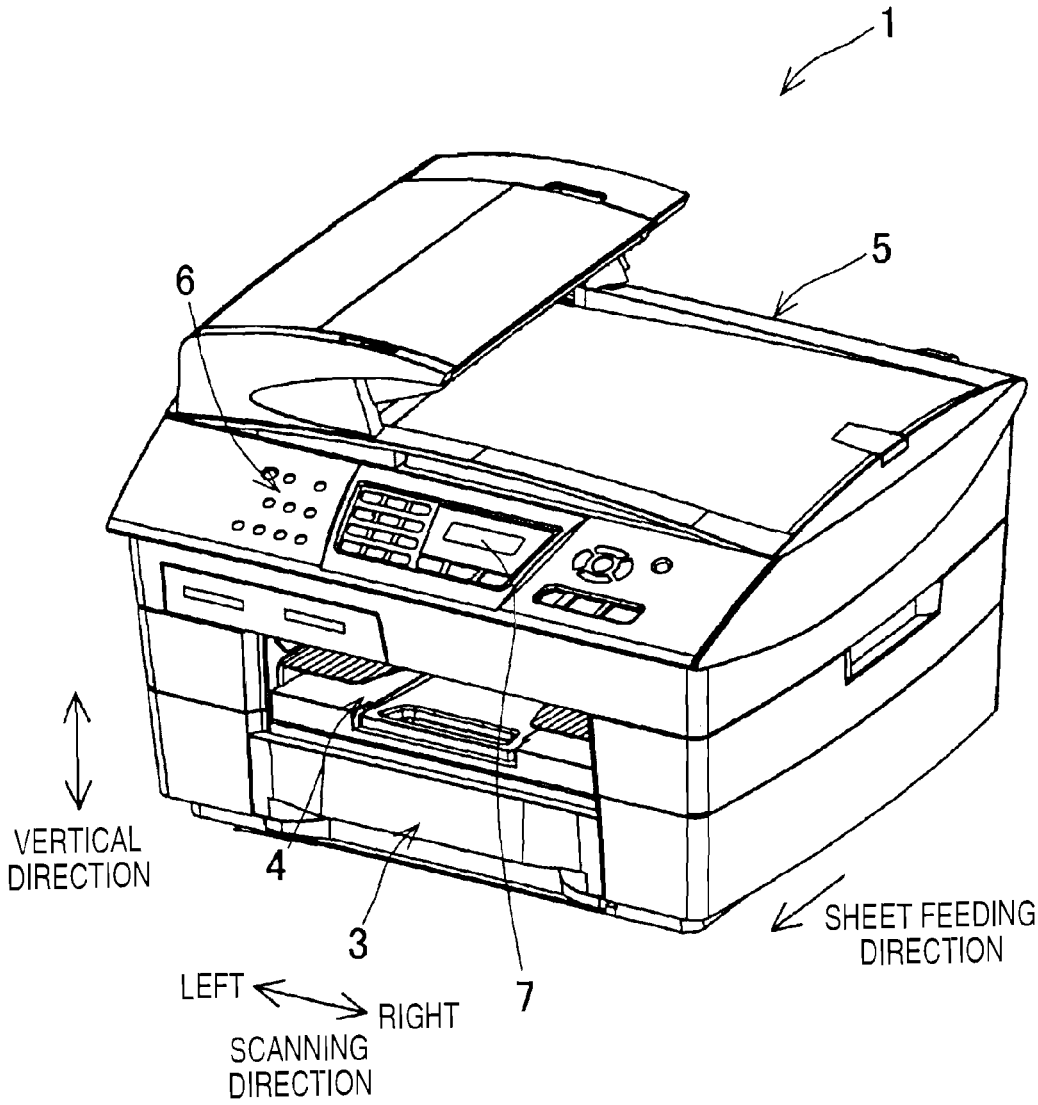
FIG. 1 is a perspective view schematically showing a configuration of an inkjet printer in an embodiment according to one or more aspects of the present invention.
Figure 2:
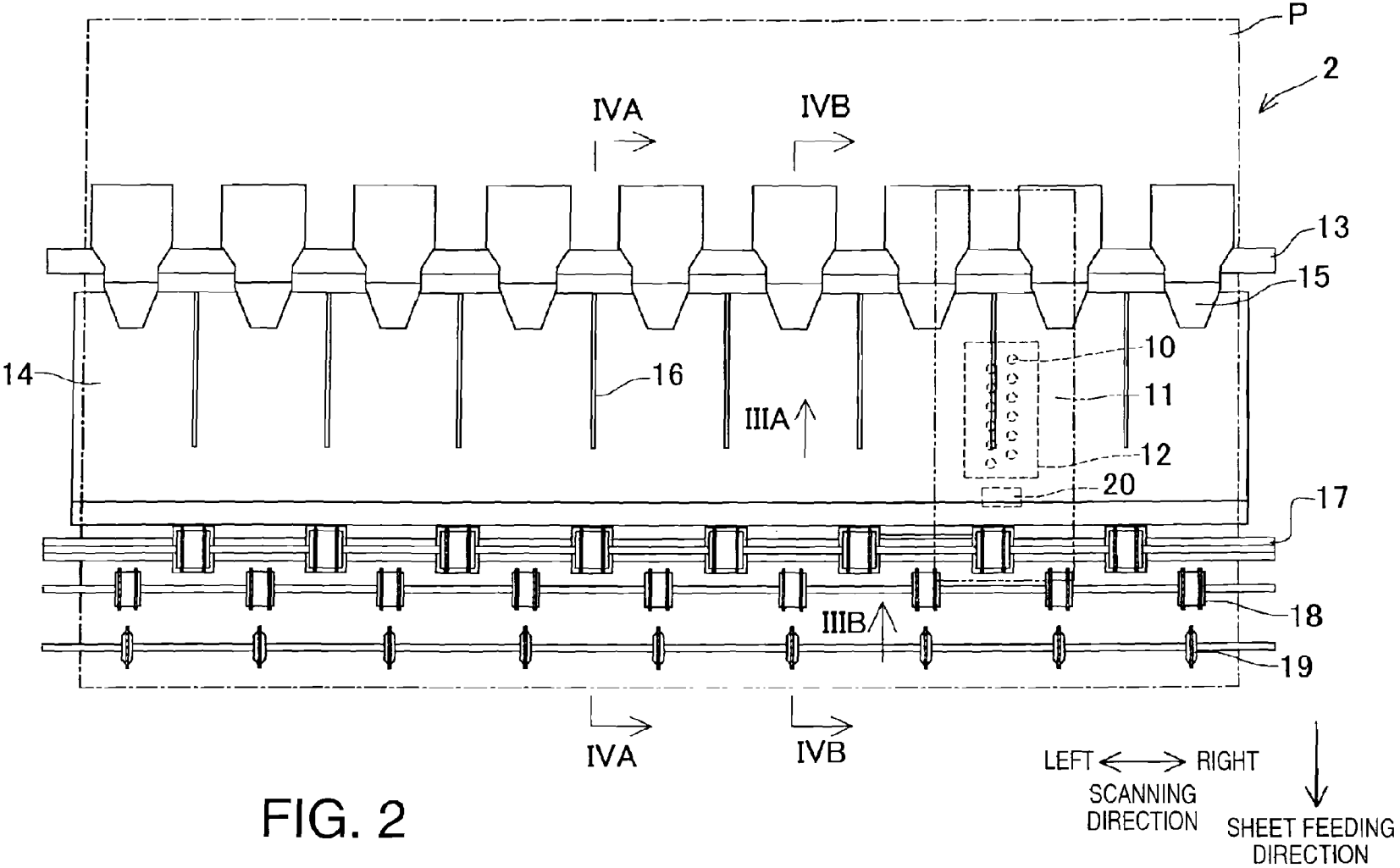
FIG. 2 is a top view of a printing unit of the inkjet printer in the embodiment according to one or more aspects of the present invention.
Figure 3A:
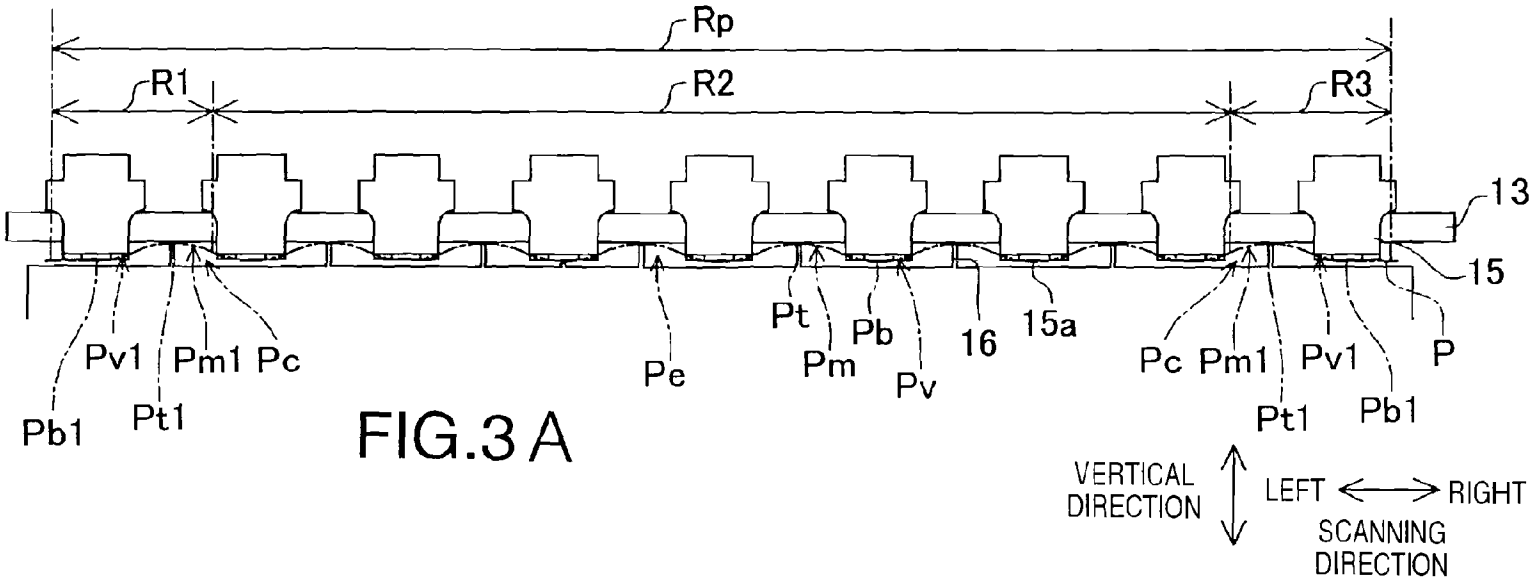

FIG. 3A schematically shows a part of the printing unit when viewed along an arrow IIIA shown in FIG. 2 in the embodiment according to one or more aspects of the present invention.

Figure 3B:
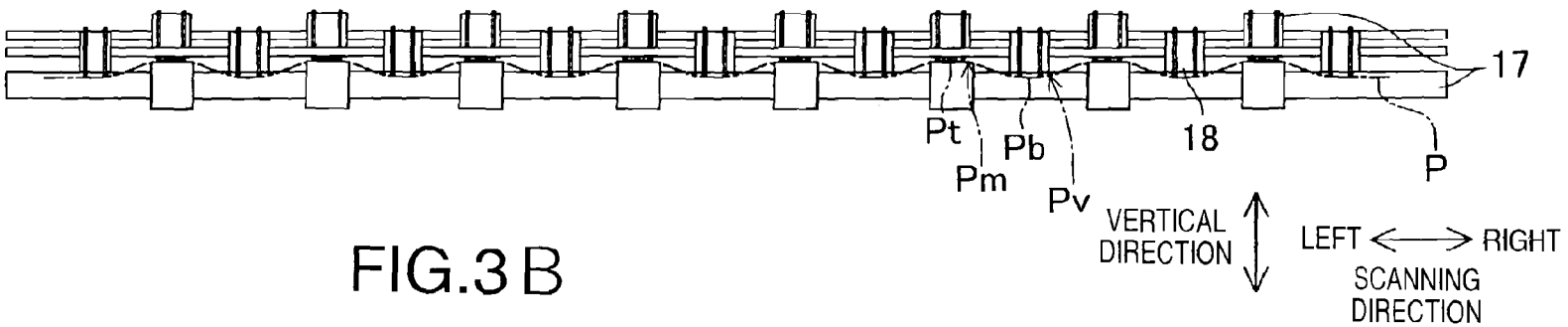

FIG. 3B schematically shows a part of the printing unit when viewed along an arrow IIIB shown in FIG. 2 in the embodiment according to one or more aspects of the present invention.

Figure 4A:
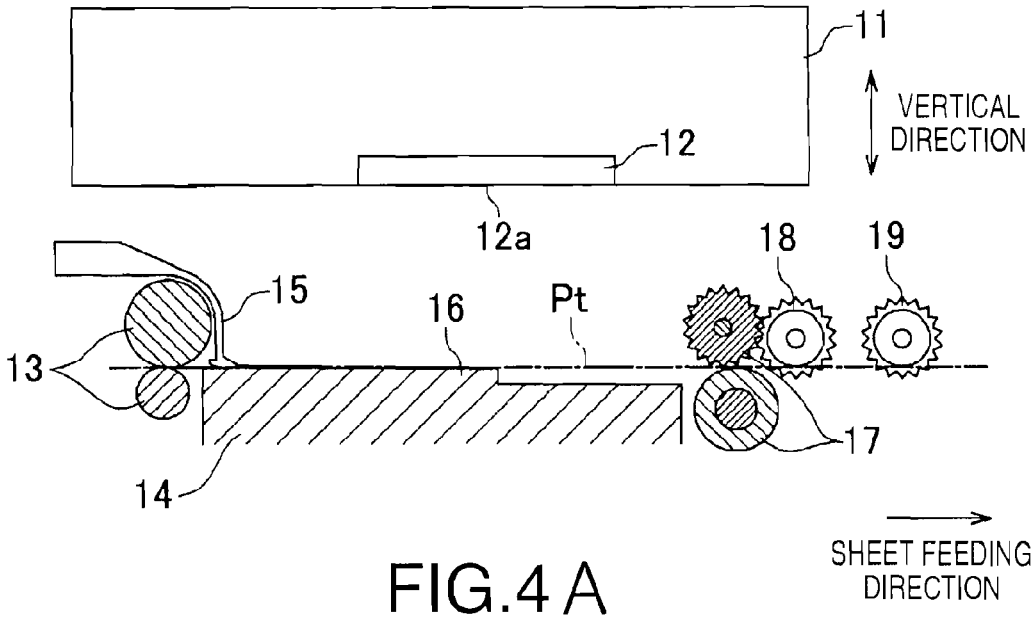

FIG. 4A is a cross-sectional view taken along a line IVA-IVA shown in FIG. 2 in the embodiment according to one or more aspects of the present invention.

Figure 4B:
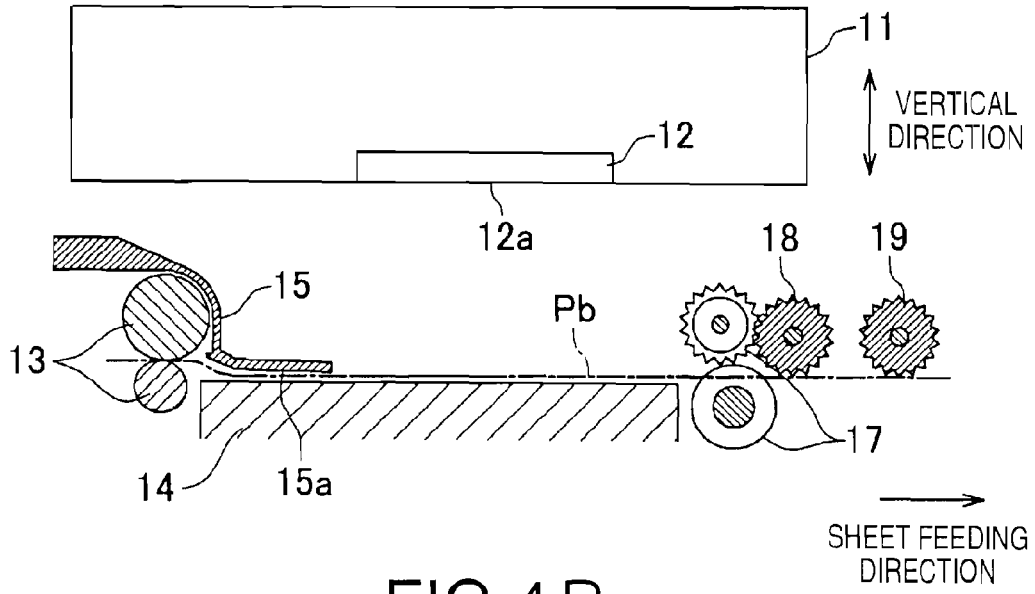

FIG. 4B is a cross-sectional view taken along a line IVB-IVB shown in FIG. 2 in the embodiment according to one or more aspects of the present invention.

Figure 5:
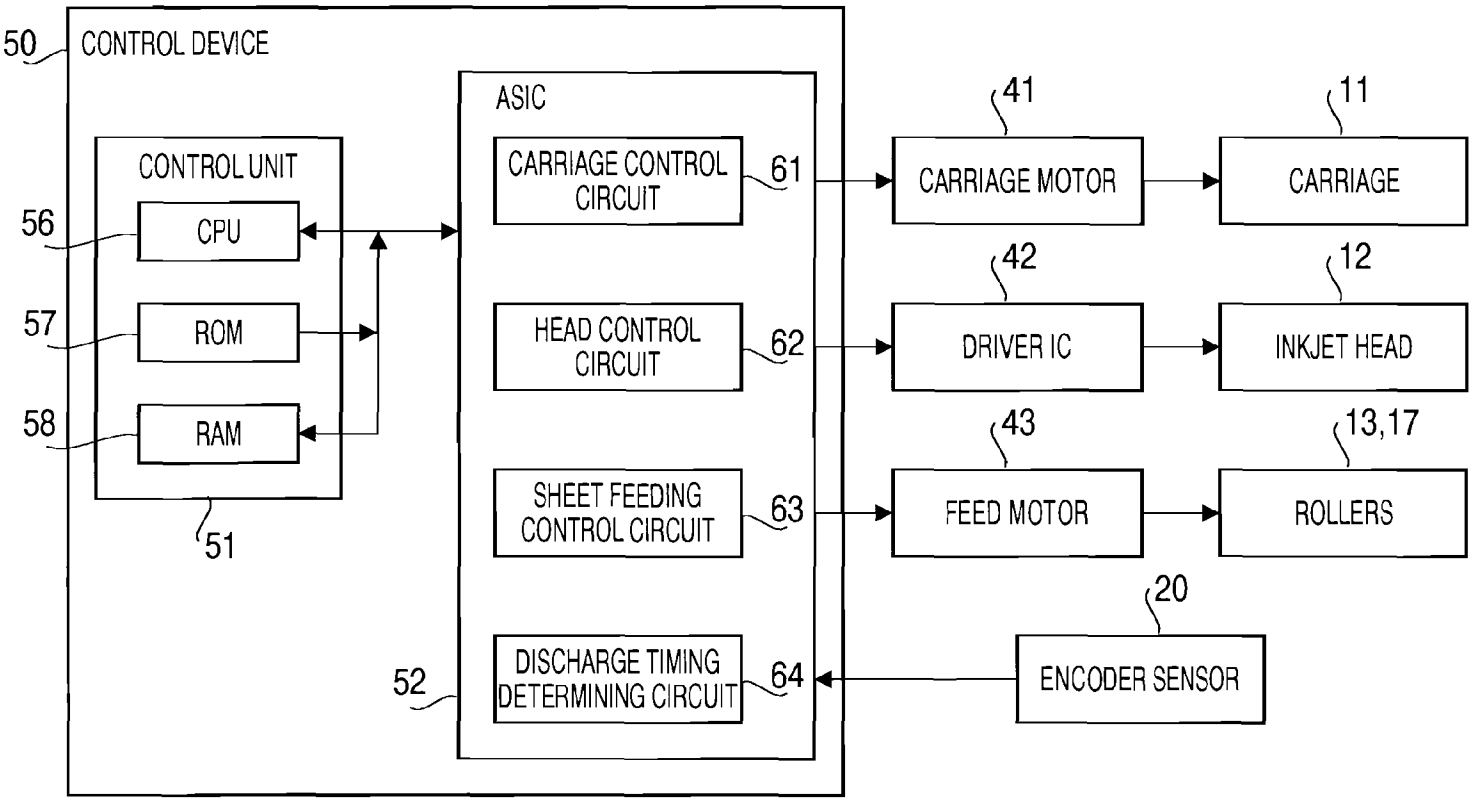

FIG. 5 is a block diagram of a control device of the inkjet printer in the embodiment according to one or more aspects of the present invention.

Figure 6:
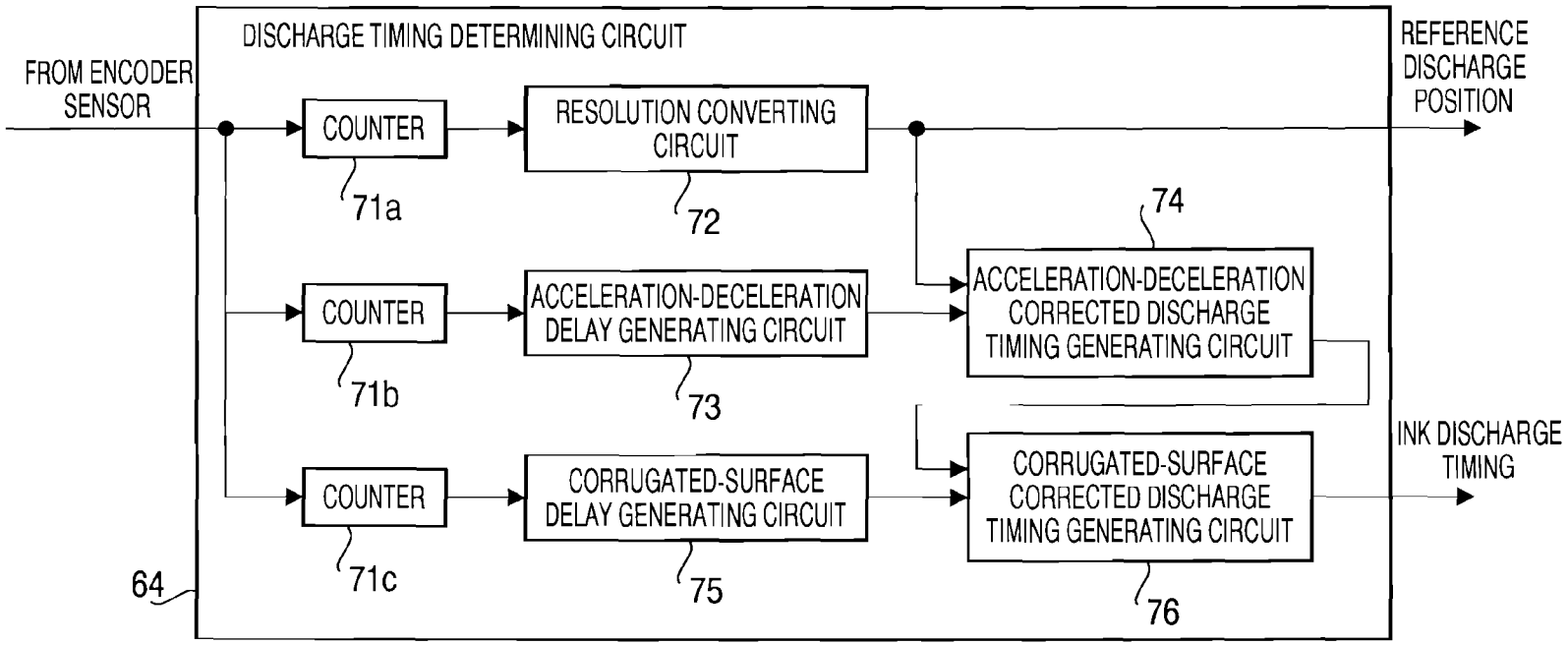

FIG. 6 is a block diagram of a discharge timing determining circuit of the control device in the embodiment according to one or more aspects of the present invention.

Figures 7A, 7B, 7C, 7D, 7E, 7F:
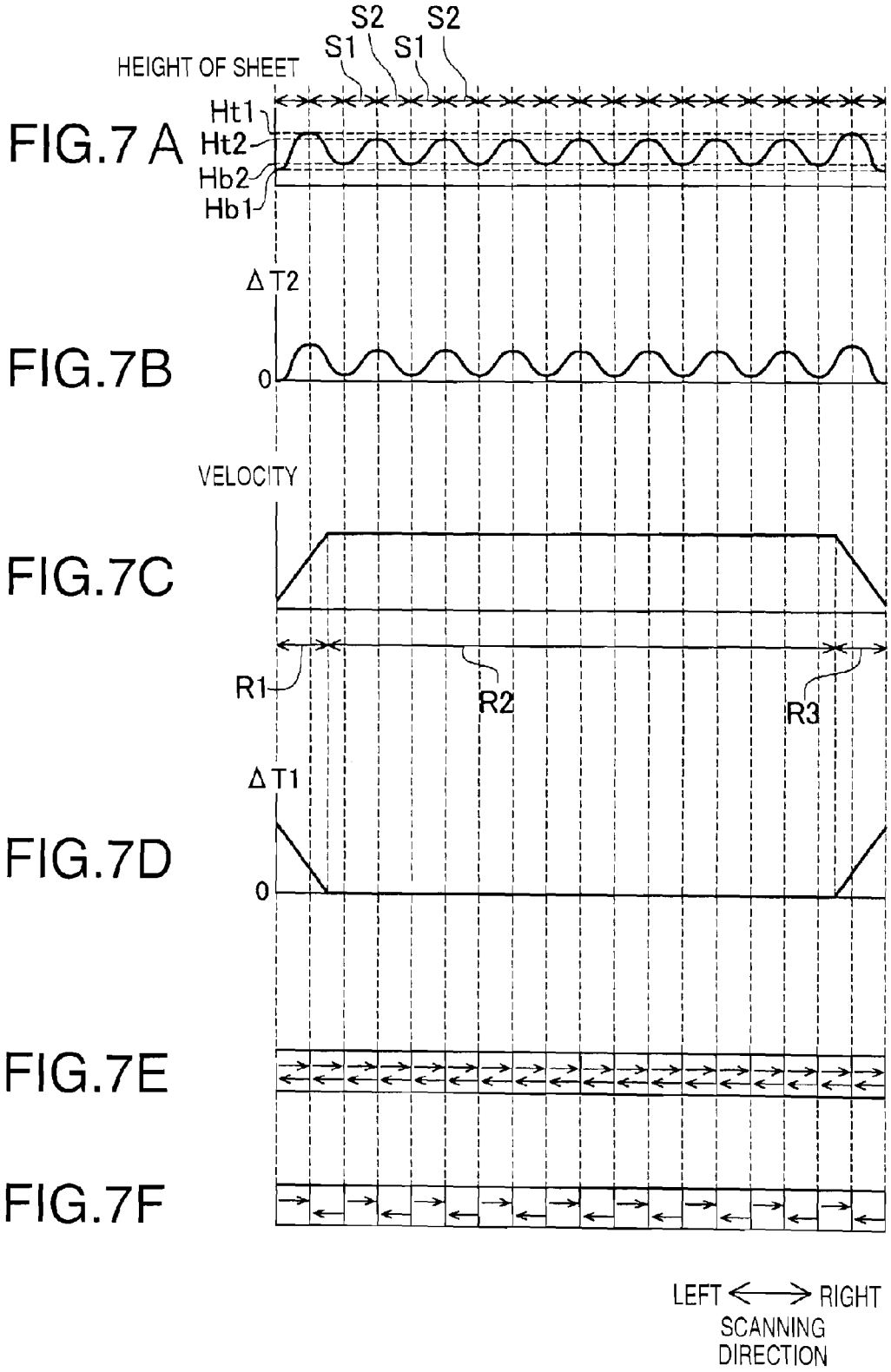

FIG. 7A shows a relationship between a position in a scanning direction and a height of a wave-shaped recording sheet in the embodiment according to one or more aspects of the present invention.

FIG. 7B shows a relationship between the position in the scanning direction and a delay time $\Delta T2$ for determining ink discharge timing in the embodiment according to one or more aspects of the present invention.

FIG. 7C shows a relationship between the position in the scanning direction and a moving velocity of a carriage (an inkjet head) in the embodiment according to one or more aspects of the present invention.

FIG. 7D shows a relationship between the position in the scanning direction and a delay time $\Delta T1$ for determining the ink discharge timing in the embodiment according to one or more aspects of the present invention.

FIG. 7E shows a relationship between the position in the scanning direction and an ink landing area of the recording sheet onto which the inkjet head is controlled to discharge ink droplets while moving in each moving direction thereof in a first discharge mode in the embodiment according to one or more aspects of the present invention.

FIG. 7F shows a relationship between the position in the scanning direction and an ink landing area of the recording sheet onto which the inkjet head is controlled to discharge ink droplets while moving in each moving direction thereof in a second discharge mode in the embodiment according to one or more aspects of the present invention.

Figure 8A:
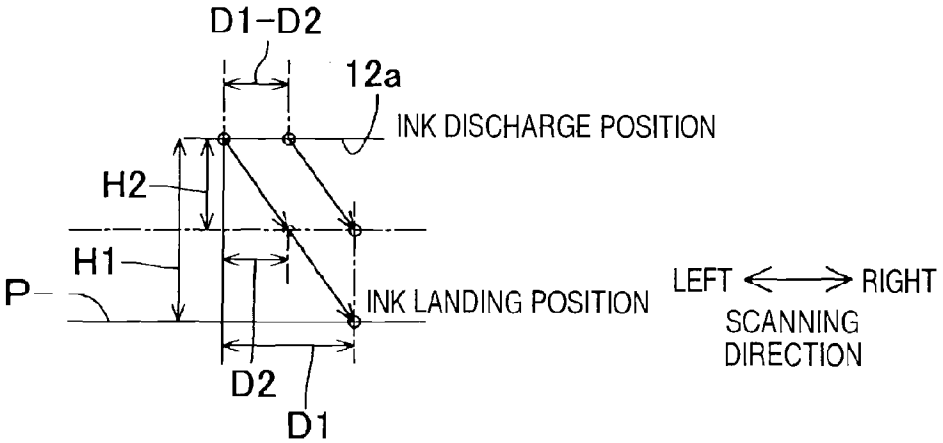

FIG. 8A illustrates a deviation between an ink discharge position where an ink droplet is discharged from the inkjet head and an ink landing position on the recording sheet where the discharged ink droplet lands, depending on a distance between an ink discharge surface and the recording sheet, in the embodiment according to one or more aspects of the present invention.

Figure 8B:
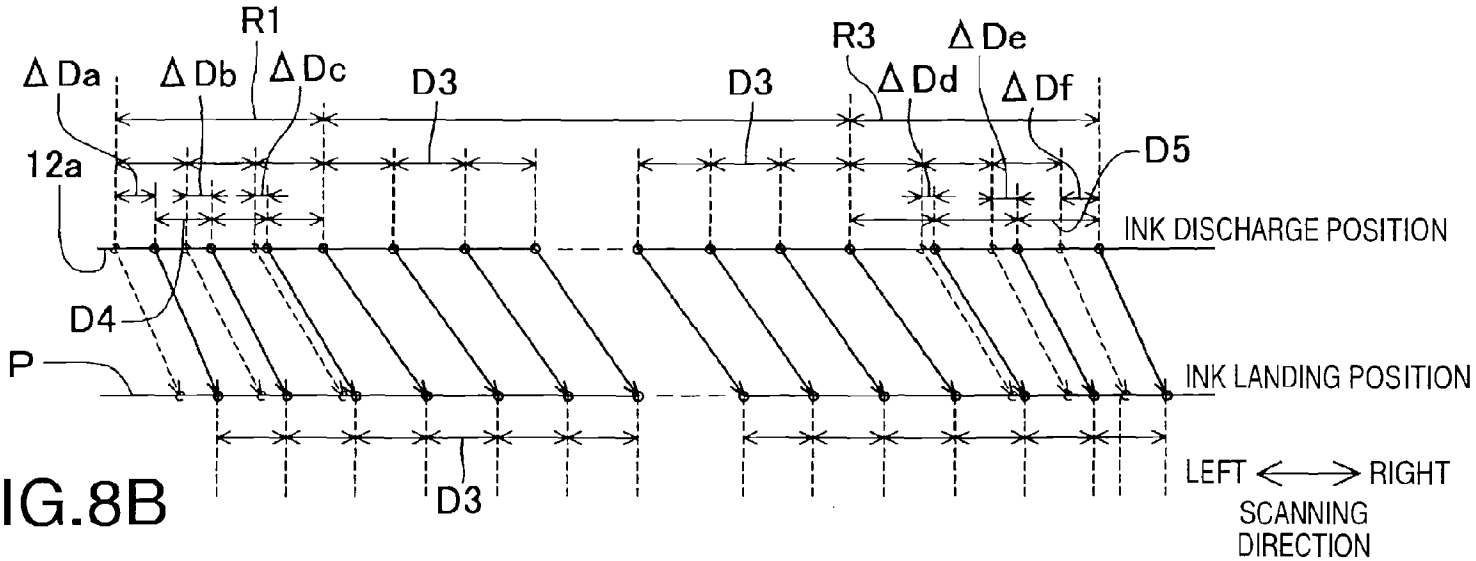

FIG. 8B illustrates deviations between the ink discharge position and the ink landing position, depending on changes in the moving velocity of the inkjet head, in the embodiment according to one or more aspects of the present invention.

Figure 9A:
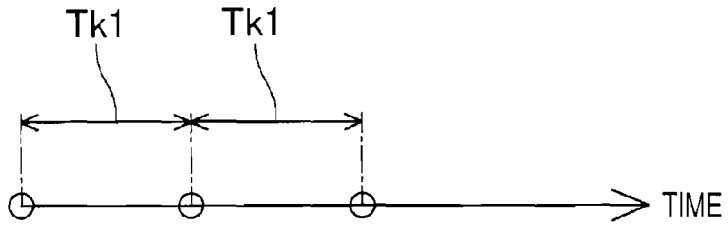

FIG. 9A shows reference discharge timings (moments) to discharge ink droplets from the inkjet head that is moving at a constant velocity in the embodiment according to one or more aspects of the present invention.

Figure 9B:
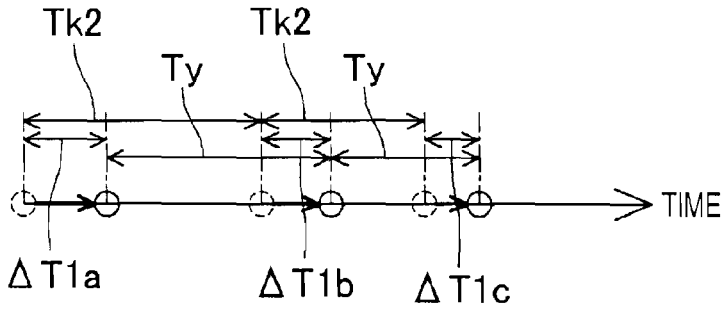

FIG. 9B shows ink discharge timings (moments) to discharge ink droplets from the inkjet head that is accelerating in the embodiment according to one or more aspects of the present invention.

Figure 9C:
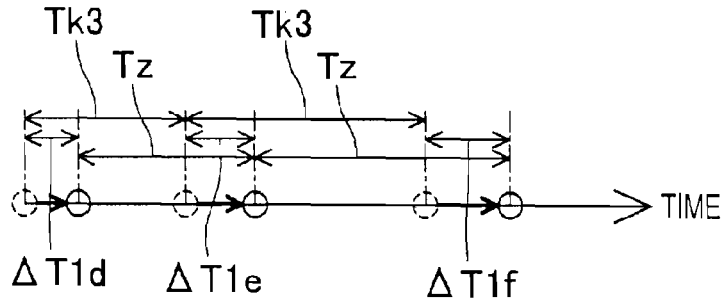

FIG. 9C shows ink discharge timings (moments) to discharge ink droplets from the inkjet head that is decelerating in the embodiment according to one or more aspects of the present invention.

Figure 10A:
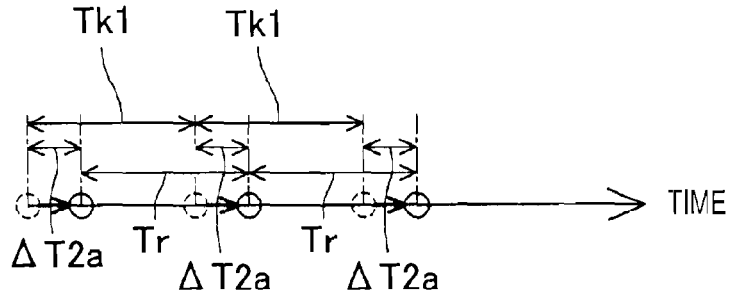

FIG. 10A shows ink discharge timings (moments) to discharge ink droplets from the nozzle onto the recording sheet with an even height (with a horizontal surface) in the embodiment according to one or more aspects of the present invention.

Figure 10B:
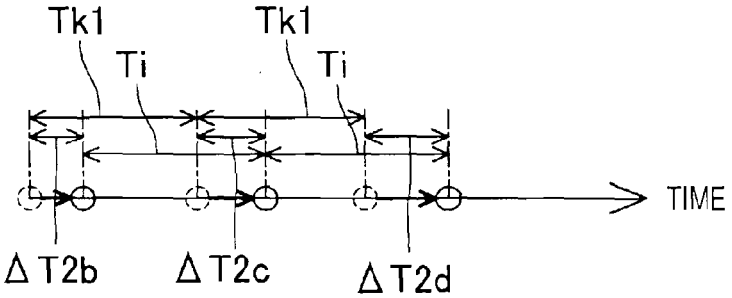

FIG. 10B shows ink discharge timings (moments) to discharge ink droplets from the nozzle onto an ascending area of the recording sheet in the embodiment according to one or more aspects of the present invention.

Figure 10C:
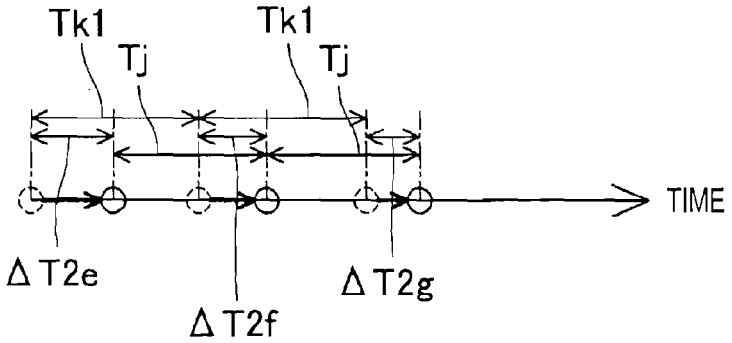

FIG. 10C shows ink discharge timings (moments) to discharge ink droplets from the nozzle onto a descending area of the recording sheet in the embodiment according to one or more aspects of the present invention.

Figure 11:
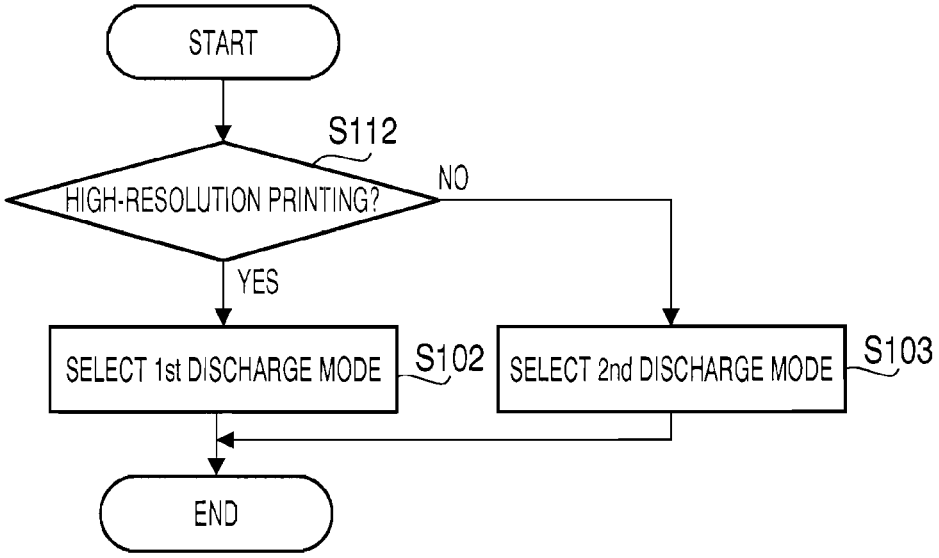

FIG. 11 is a flowchart showing a process to determine an ink discharge mode for a printing operation in the embodiment according to one or more aspects of the present invention.

Figure 12A:
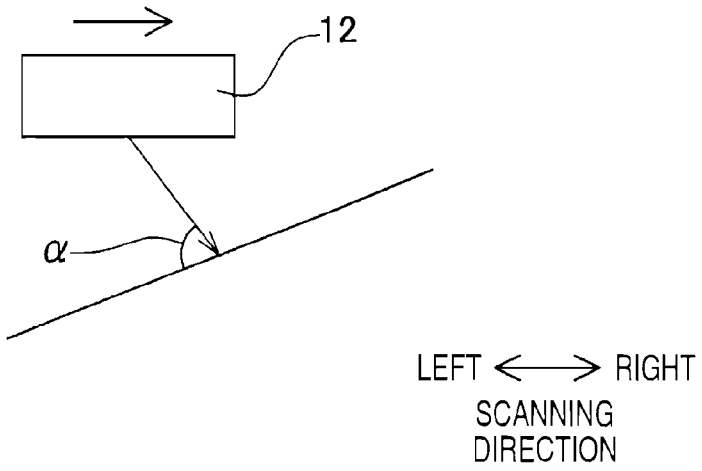

FIG. 12A shows a relationship between a flying direction of an ink droplet discharged from the inkjet head and an extending direction of the ascending area of the recording sheet in the embodiment according to one or more aspects of the present invention.

Figure 12B:
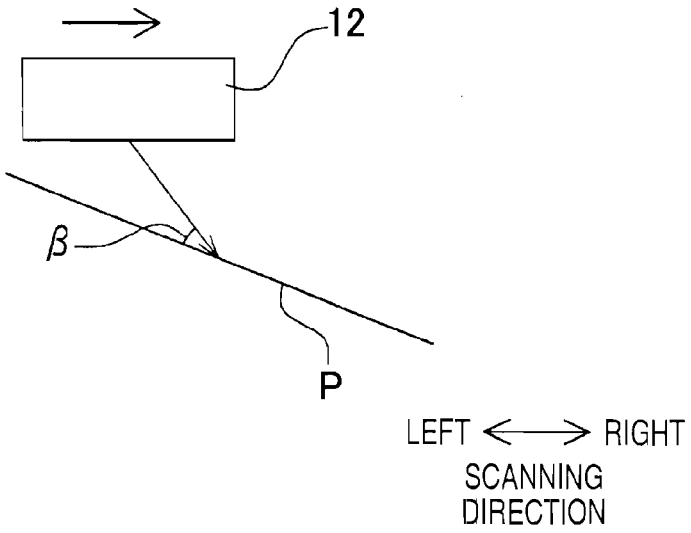

FIG. 12B shows a relationship between a flying direction of an ink droplet discharged from the inkjet head and an extending direction of the descending area of the recording sheet in the embodiment according to one or more aspects of the present invention.

DETAILED DESCRIPTION

It is noted that various connections are set forth between elements in the following description. It is noted that these connections in general and, unless specified otherwise, may be direct or indirect and that this specification is not intended to be limiting in this respect. Aspects of the invention may be implemented on circuits (such as application specific integrated circuits) or in computer software as programs storable on computer readable media including but not limited to RAMs, ROMs, flash memories, EEPROMs, CD-media, DVD-media, temporary storage, hard disk drives, floppy drives, permanent storage, and the like.

Hereinafter, an embodiment according to aspects of the present invention will be described in detail with reference to the accompanying drawings.

An inkjet printer 1 of the embodiment is a multi-function peripheral having a plurality of functions such as a printing function to perform printing on a recording sheet P and an image reading function. The inkjet printer 1 includes a printing unit 2 (see FIG. 2), a sheet feeding unit 3, a sheet ejecting unit 4, a reading unit 5, an operation unit 6, and a display unit 7. Further, the inkjet printer 1 includes a control device 50 configured to control operations of the inkjet printer 1 (see FIG. 5).

The printing unit 2 is disposed inside the inkjet printer 1. The printing unit 2 is configured to perform printing on the recording sheet P. A detailed configuration of the printing unit 2 will be described later. The sheet feeding unit 3 is configured to feed the recording sheet P to be printed by the printing unit 2. The sheet ejecting unit 4 is configured to eject the recording sheet P printed by the printing unit 2. The reading unit 5 is configured, e.g., as an image scanner, to read images. The operation unit 6 is provided with buttons. A user is allowed to operate the inkjet printer 1 via the buttons of the operation unit 6. The display unit 7 is configured, e.g., as a liquid crystal display, to display information necessary in the use of the inkjet printer 1.

Subsequently, the printing unit 2 will be described. As shown in FIGS. 2 to 4, the printing unit 2 includes a carriage 11, an inkjet head 12, feed rollers 13, a platen 14, a plurality of corrugated plates 15, a plurality of ribs 16, ejection rollers 17, and a plurality of corrugated spur wheels 18 and 19. It is noted that, for the sake of easy visual understanding in FIG. 2, the carriage 11 is indicated by a long dashed double-short dashed line, and portions disposed below the carriage 11 are indicated by solid lines.

The carriage 11 is configured to reciprocate along a scanning direction while guided by a guiderail (not shown). The inkjet head 12 is mounted on the carriage 11. The inkjet head 12 is configured to discharge ink droplets from a plurality of nozzles 10 formed in an ink discharge surface 12*a* that is a lower surface of the inkjet head 12. The feed rollers 13 are two rollers configured to pinch therebetween the recording sheet P fed by the sheet feeding unit 3 and feed the recording sheet P in a sheet feeding direction perpendicular to the scanning direction. The platen 14 is disposed to face the ink discharge surface 12*a*. The recording sheet P is fed by the feed rollers 13, along an upper surface of the platen 14.

The plurality of corrugated plates 15 are disposed to face an upper surface of an upstream end of the platen 14 in the sheet feeding direction. The plurality of corrugated plates 15 are arranged at substantially regular intervals along the scanning direction. The recording sheet P, fed by the feed rollers 13, passes between the platen 14 and the corrugated plates 15. At this time, the recording sheet P is pressed from above by pressing surfaces 15*a* that are lower surfaces of the plurality of corrugated plates 15. Each individual rib 16 is disposed between corresponding two mutually-adjacent corrugated plates 15 in the scanning direction, on the upper surface of the platen 14. The plurality of ribs 16 are arranged at substantially regular intervals along the scanning direction. Each rib 16 protrudes from the upper surface of the platen 14 up to a level higher than the pressing surfaces 15*a* of the corrugated plates 15. Each rib 16 extends from an upstream end of the platen 14 toward a downstream side in the sheet feeding direction. Thereby, the recording sheet P on the platen 14 is supported from underneath by the plurality of ribs 16.

The ejection rollers 17 are two rollers configured to pinch therebetween portions of the recording sheet P that are located in the same positions as the plurality of ribs 16 in the scanning direction and feed the recording sheet P toward the sheet ejecting unit 4. An upper one of the ejection rollers 17 is provided with spur wheels so as to prevent the ink attached onto the recording sheet P from transferring to the upper ejection roller 17. The plurality of corrugated spur wheels 18 are disposed substantially in the same positions as the corrugated plates 15 in the scanning direction, at a downstream side relative to the ejection rollers 17 in the sheet feeding direction. The plurality of corrugated spur wheels 19 are disposed substantially in the same positions as the corrugated plates 15 in the scanning direction, at a downstream side relative to the corrugated spur wheels 18 in the sheet feeding direction. In addition, the plurality of corrugated spur wheels 18 and 19 are placed at a level lower than a position where the ejection rollers 17 pinch the recording sheet P therebetween, in the vertical direction. The plurality of corrugated spur wheels 18 and 19 are configured to press the recording sheet P from above at the level. Further, each of the plurality of corrugated spur wheels 18 and 19 is not a roller having a flat outer circumferential surface but a spur wheel. Therefore, it is possible to prevent the ink attached onto the recording sheet P from transferring to the plurality of corrugated spur wheels 18 and 19.

Thus, the recording sheet P on the platen 14 is pressed from above by the plurality of corrugated plates 15 and the plurality of corrugated spur wheels 18 and 19, and is supported from underneath by the plurality of ribs 16. Thereby, as shown in FIGS. 3A, 3B, and 7A, the recording sheet P on the platen 14 is deformed and held in such a wave shape that mountain portions Pm protruding upward (i.e., toward the ink discharge surface 12*a*) and valley portions Pv recessed downward (i.e., in a direction opposite to the direction toward the ink discharge surface 12*a*) are alternately arranged. In other words, the recording sheet P on the platen 14 is corrugated in such a corrugated form as to have ridges and grooves (flutes) extending along the sheet feeding direction and alternating along the scanning direction. Further, each mountain portion Pm has a top portion (peak portion) Pt, protruding up to the highest level of the mountain portion Pm, which is located substantially in the same position as a center of the corresponding rib 16 in the scanning direction. Each valley portion Pv has a bottom portion Pb, recessed down to the lowest level of the valley portion Pv, which is located substantially in the same position as the corresponding corrugated plate 15 and the corresponding corrugated spur wheels 18 and 19.

Further, outmost corrugated plates 15 in the scanning direction are positionally adjusted so as to press the recording sheet P more strongly than the other corrugated plates 15. Thereby, the both ends of the recording sheet P in the scanning direction are more strongly pressed, and thus it is possible to put the recording sheet P in a stable state. Further, thereby, as shown in FIG. 7, a height Ht1 of outmost top portions Pt1 in the scanning direction is greater than a height Ht2 of the other top portions Pt. In addition, a height Hb1 of outmost bottom portions Pb1 in the scanning direction is lower than a height Hb2 of the other bottom portions Pb. Thereby, mountain portions Pm1 that include the top portions Pt1 have a greater amplitude than the amplitude of the other mountain portions Pm. Further, valley portions Pv1 including the bottom portions Pb1 have a greater amplitude than the amplitude of the other valley portions Pv.

An encoder sensor 20 is mounted on the carriage 11. The encoder sensor 20, together with an encoder belt (not shown) extending along the scanning direction, forms a linear encoder. The encoder sensor 20 is configured to detect slits formed in the encoder belt and thereby detect a position of the inkjet head 12 moving together with the carriage 11 along the scanning direction.

The printing unit 2 configured as above performs printing on the recording sheet P, by discharging ink droplets from the inkjet head 12 reciprocating together with the carriage 11 along the scanning direction while feeding the recording sheet P in the sheet feeding direction by the feed rollers 13 and the ejection rollers 17.

At this time, when moving rightward along the scanning direction, the carriage 11 accelerates up to a predetermined velocity in a range R1 (an acceleration range) facing a left end area of the recording sheet P. Subsequently, the carriage 11 moves at the predetermined velocity in a range R2 (a constant-velocity range) that is located on a right side of the range R1 and faces an intermediate area other than both end areas of the recording sheet P in the scanning direction. Then, the carriage 11 decelerates in a range R3 (a deceleration range) that is located on a right side of the range R2 and faces a right end area of the recording sheet P. On the contrary, when moving leftward along the scanning direction, the carriage 11 accelerates up to the predetermined velocity in the range R3 (the acceleration range), moves at the predetermined velocity in the range R2 (the constant-velocity range), and decelerates in the range R1 (the deceleration range).

In the embodiment, a printing operation is performed all over the areas of the recording sheet P that face the ranges R1, R2, and R3. In other words, all the ranges R1, R2, and R3 are included in a printable range Rp for the recording sheet P. Ink droplets, discharged from the nozzles 10 when the carriage 11 is within the ranges R1 and R3 where the carriage 11 accelerates or decelerates, land on two acceleration-deceleration print areas Pc that correspond to the both end areas of the recording sheet P in the scanning direction, respectively. Further, ink droplets, discharged from the nozzles 10 when the carriage 11 is within the range R2 where the carriage 11 moves at the predetermined velocity, land on a constant-velocity print area Pe between the two acceleration-deceleration print areas Pc. The aforementioned mountain portions Pm1 and valley portions Pv1 are included in the acceleration-deceleration print areas Pc.

Next, an explanation will be provided about the control device 50 for controlling the operations of the inkjet printer 1. The control device 50 includes a control unit 51 and an application specific integrated circuit (ASIC) 52. The control unit 51 includes a central processing unit (CPU) 56, a read only memory (ROM) 57, and a random access memory (RAM) 58 interconnected via a bus. The CPU 56 is configured to issue instructions to the ASIC 52 and determine a below-mentioned discharge mode in accordance with data values and control programs stored on the ROM 57 and RAM 58.

The ASIC 52 includes various control circuits such as a carriage control circuit 61 configured to control a carriage motor 41 for driving the carriage 11, a head control circuit 62 configured to control a driver IC 42 for driving the inkjet head 12, a sheet feeding control circuit 63 configured to control a feed motor 43 for driving the feed rollers 13 and the ejection rollers 17, and a discharge timing determining circuit 64 configured to determine ink discharge timings (moments) to discharge ink droplets from the nozzles 10. It is noted that the term "timing," which will frequently be referred to in the following description, may have the same meaning as "a moment" or "a time." The ASIC 52 is configured to, in response to receiving instructions from the control unit 51, control the elements included in the inkjet printer 1 such that the inkjet printer 1 performs printing.

The discharge timing determining circuit 64 will be described in detail. As shown in FIG. 6, the discharge timing determining circuit 64 includes three counters 71*a*, 71*b*, and 71*c*, a resolution converting circuit 72, an acceleration-deceleration delay generating circuit 73, an acceleration-deceleration corrected discharge timing generating circuit 74, a corrugated-surface delay generating circuit 75, and a corrugated-surface corrected discharge timing generating circuit 76.

The counters 71*a*, 71*b*, and 71*c* are configured to count the number of slits of the encoder belt (not shown) detected by the encoder sensor 20. The resolution converting circuit 72 is configured to determine a position, corresponding to a resolution of printing, of the inkjet head 12 in the scanning direction, based on the number of the slits counted by the counter 71*a*.

The acceleration-deceleration delay generating circuit 73 is configured to determine a delay time ΔT1 depending on the moving velocity of the inkjet head 12, in a below-mentioned manner, from the number of slits counted per unit time by the counter 71*b*. The acceleration-deceleration corrected discharge timing generating circuit 74 is configured to determine the ink discharge timing based on a reference discharge position (an ink discharge position in the case of no delay time) determined by the resolution converting circuit 72, and on the delay time ΔT1 determined by the acceleration-deceleration delay generating circuit 73. Specifically, the acceleration-deceleration corrected discharge timing generating circuit 74 determines, as the ink discharge timing, a time delayed by the delay time ΔT1 determined by the acceleration-deceleration delay generating circuit 73 with respect to a reference discharge timing (moment) for discharging ink in the reference discharge position determined by the resolution converting circuit 72.

As will be described, the corrugated-surface delay generating circuit 75 is configured to determine a delay time ΔT2 required for attaining regular intervals of ink landing positions on the wave-shaped recording sheet P in the scanning direction. Specifically, when the corrugated plates 15, the ribs 16, and the corrugated spur wheels 18 and 19 are disposed as described above, the recording sheet P has a height varying depending on a position thereof in the scanning direction. The corrugated-surface delay generating circuit 75 acquires the position of the inkjet head 12 in the scanning direction based on the number of the slits counted by the counter 71*c*, and acquires the height of a corresponding portion of the recording sheet P based on the acquired position of the inkjet head 12 in the scanning direction. Then, the corrugated-surface delay generating circuit 75 determines the delay time ΔT2 depending on the acquired height of the recording sheet P in a below-mentioned manner.

The corrugated-surface corrected discharge timing generating circuit 76 is configured to further adjust the ink discharge timing determined by the acceleration-deceleration corrected discharge timing generating circuit 74 and determine final ink discharge timing. Specifically, the corrugated-surface corrected discharge timing generating circuit 76 determines, as the final ink discharge timing, a time delayed by the delay time ΔT2 with respect to the ink discharge timing determined by the acceleration-deceleration corrected discharge timing generating circuit 74. Namely, the final ink discharge timing is determined as a time delayed, with respect to the reference discharge timing, by the delay time ΔT1 determined depending on the moving velocity of the inkjet head 12 and the delay time ΔT2 determined depending on the height of the wave-shaped recording sheet P.

Next, the delay times ΔT1 and ΔT2 will be described. When the recording sheet P is held in a wave shape as shown in FIG. 7A, a vertical distance between the ink discharge surface 12*a* and the recording sheet P varies depending on a portion (position) of the recording sheet P. Accordingly, for instance, as shown in FIG. 8A, when the vertical distance between the ink discharge surface 12*a* and the recording sheet P is a distance H1, a discharged ink droplet lands in a position deviated from an ink discharge position by a distance D1 in the scanning direction. Meanwhile, when the vertical distance between the ink discharge surface 12*a* and the recording sheet P is a distance H2 (<H1), the discharged ink droplet lands in a position deviated from the ink discharge position by a distance D2 in the scanning direction. Therefore, in order to land the ink droplet in the same position in the scanning direction as when the vertical distance between the ink discharge surface 12*a* and the recording sheet P is the distance H1 even when the vertical distance is the distance H2, it is required to displace the ink discharge position to discharge the ink droplet from the nozzles 10 by a distance "D1-D2" in the scanning direction, as shown in FIG. 8A. In addition, it is required to delay the ink discharge timing to discharge the ink droplet from the nozzles 10.

In the embodiment, as shown in FIG. 7B, the delay time ΔT2 is set to zero for the outmost bottom portions Phi, which have the lowest height among all the bottom portions Pb, at the both ends of the recording sheet P in the scanning direction. With respect to the other portions of the wave-shaped recording sheet P, the delay time ΔT2 is set to be longer for a portion having a greater height relative to the outmost bottom portions Pb1. Namely, the delay time ΔT2 is a delay time depending on the height relative to the outmost bottom portions Pb1 with respect to ink discharge timing (moment) based on an assumption that (the surface of) the recording sheet P is as high as the outmost bottom portions Pb1.

Further, in the embodiment, as shown in FIG. 7C, when the inkjet head 12 is within the range R1 or the range R3 (while the inkjet head 12 is accelerating or decelerating), the carriage 11 moves at a lower velocity than when the inkjet head 12 is within the range R2 (while the inkjet head 12 is moving at the constant velocity). As the moving velocity of the carriage 11 is lower, a component in the scanning direction of a flying velocity of the ink droplet discharged from the nozzles 10 is smaller, and a difference in the scanning direction between the ink discharge position and the ink landing position is smaller.

Specifically, for instance, when the inkjet head 12 moves rightward, as shown in FIG. 8B, within the range R2, the moving velocity of the inkjet head 12 is constant. Therefore, if the distance between the ink discharge surface 12*a* and the recording sheet P is constant, an ink droplet, when discharged from the nozzles 10 each time the inkjet head 12 moves by the distance D3, lands at regular intervals of the distance D3 in the scanning direction on the recording sheet P.

On the contrary, the inkjet head 12, which is within the range R1 or the range R3, moves at a velocity that is lower than when the inkjet head 12 is within the range R2 and varies depending on the position of the inkjet head 12 in the scanning direction. Therefore, a component in the scanning direction of an ink discharge velocity varies depending on each reference discharge position of the inkjet head 12. Hence, an ink droplet, when discharged from the nozzles 10 each time the inkjet head 12 moves by the distance D3, sequentially lands on the recording sheet P while changing the ink landing position relative to a corresponding ink discharge position of the inkjet head 12, as indicated by a dashed line in FIG. 8B.

Accordingly, in order to land the ink droplets at regular intervals in the scanning direction on the recording sheet P, when the inkjet head 12 is within the range R1 or the range R3, it is required to displace the ink discharge positions in the scanning direction with respect to the respective reference discharge positions (see dashed arrows in FIG. 8B) to be coincident with positions indicated by solid arrows in FIG. 8B. Thus, it is required to delay the ink discharge timings (moments) to discharge the ink droplets from the nozzles 10.

In the embodiment, under the assumption that the recording sheet P is not held in the wave shape, when "Ta" represents a time period from a time when an ink droplet is disposed from the nozzles 10 to a time when the discharged ink droplet lands on the recording sheet P, "Tx" represents a count period that is a reciprocal of the number of slits counted per a unit time by the counter 71*b*, and "Ts" represents a minimum count period previously set as a minimum value of the count period T, the delay time ΔT1 is determined as the following expression 1. It is noted that the minimum count period Ts is set based on design values of factors such as the moving velocity of the inkjet head 12 in the range R2 (a maximum moving velocity of the inkjet head 12) and the interval of the slit, and is the same as the count period when the inkjet head 12 moves in the range R2.

$$\Delta T1 = \frac{Tx - Ts}{Ts} \times Ta \qquad \text{(Expression 1)}$$

At this time, the count period Tx is shorter, as the moving velocity of the inkjet head 12 is higher when the inkjet head 12 is within the range R1 or the range R3 (while the inkjet head 12 is accelerating or decelerating). Further, the count period Tx is identical to the minimum count period Ts when the inkjet head 12 is within the range R2 (while the inkjet head 12 is moving at the constant velocity). Accordingly, as shown in FIG. 7D, the delay time ΔT1 is zero when the inkjet head 12 is within the range R2. Further, the delay time ΔT1 is longer as the moving velocity of the inkjet head 12 is lower in the range R1 or the range R3.

Thus, in the case where the ink discharge positions are displaced in the ranges R1 and R3, for instance, as shown in FIG. 8B, ink discharge positions, at three successive ink discharge timings (moments) when the inkjet head 12 moves rightward while accelerating in the range R1, are displaced with respect to their reference discharge positions by displacement distances ΔDa, ΔDb (<ΔDa), ΔDc (<ΔDb), respectively. Meanwhile, ink discharge positions, at three successive ink discharge timings (moments) when the inkjet head 12 moves rightward while decelerating in the range R3, are displaced with respect to their reference discharge positions by displacement distances ΔDd, ΔDe (<ΔDd), ΔDf (<ΔDe), respectively.

By delaying the ink discharge timing by a delay time resulting from adding the delay time ΔT2 to the delay time ΔT1 determined in the aforementioned manner, it is possible to land ink droplets in respective appropriate positions on the wave-shaped recording sheet P in the printing operation, regardless of whether the inkjet head 12 discharges the ink droplets from the nozzles 10 while moving at the constant velocity or while accelerating or decelerating.

Subsequently, an explanation will be provided bout a relationship between a change in the moving velocity of the inkjet head 12 and time intervals of the ink discharge timings (moments).

Under the assumption that (the surface of) the recording sheet P is as high as the lowest bottom portions Pb1, in order to land ink droplets at regular intervals in the scanning direction on the recording sheet P while the inkjet head 12 is moving at the constant velocity in the range R2, the ink droplets are discharged in the reference discharge positions, as shown in FIG. 9A. At this time, the time intervals of the ink discharge timings are equal to a constant time interval Tk1. Further, at this time, each of the delay times ΔT1 and ΔT2 is zero. Further, even when (the surface of) the recording sheet P is as high as a different height, each ink droplet is merely discharged in a different position from the corresponding reference discharge position by a predetermined distance in the scanning direction, and thus the time intervals of the ink discharge timings are equal to the time interval Tk1.

On the contrary, while the inkjet head 12 is accelerating, the moving velocity of the inkjet head 12 becomes gradually higher, and is lower than when the inkjet head 12 is moving at the constant velocity. Accordingly, while the inkjet head 12 is accelerating, as shown in FIG. 9B, a later ink discharge timing (moment) is determined based on a delay time ΔT1 shorter than an earlier ink discharge timing (moment). FIG. 9B shows an example in which delay times ΔT1 for three successive ink discharge timings (moments) are represented as a delay time ΔT1*a*, a delay time ΔT1*b* (<ΔT1*a*), and a delay time ΔT1*c* (<ΔT1*b*), respectively, in an order from the earliest ink discharge timing (moment). Thereby, each individual time interval Ty of the ink discharge timing is shorter than a corresponding time interval Tk2 of the ink discharge timing based on an assumption that ink droplets are discharged in the reference discharge positions. It is noted that, with respect to the time intervals of the ink discharge timings when the inkjet head 12 discharges the ink droplets while accelerating, a time interval between later ink discharge timings becomes shorter than a time interval between earlier ink discharge timings. Nonetheless, in FIG. 9B, all the time intervals of the ink discharge timings when the inkjet head 12 discharges the ink droplets while accelerating are represented by "Tk2" for the sake of explanatory convenience.

Meanwhile, while the inkjet head 12 is decelerating, the moving velocity of the inkjet head 12 becomes gradually lower, and is lower than when the inkjet head 12 is moving at the constant velocity. Accordingly, while the inkjet head 12 is decelerating, as shown in FIG. 9C, a later ink discharge timing (moment) is determined based on a delay time ΔT1 longer than an earlier ink discharge timing (moment). In FIG. 9C, cited is an example that delay times ΔT1 for three successive ink discharge timings (moments) are ΔT1*d*, ΔT1*e* (<ΔT1*d*), ΔT1*f* (<ΔT1*e*), respectively, in an order from the earliest ink discharge timing. Thereby, each individual time interval Tz of the ink discharge timing is longer than a corresponding time interval Tk3 of the ink discharge timing based on an assumption that ink droplets are discharged in the reference discharge positions. It is noted that, with respect to the time intervals of the ink discharge timings when the inkjet head 12 discharges the ink droplets while decelerating, a time interval between later ink discharge timings (moments) becomes longer than a time interval between earlier ink discharge timings (moments). Nonetheless, in FIG. 9C, all the time intervals of the ink discharge timings when the inkjet head 12 discharges the ink droplets while decelerating are represented by "Tk3" for the sake of explanatory convenience.

In the inkjet printer 1, the moving velocity of the inkjet head 12 and the heights of the platen 14, the corrugated plates 15, the ribs 16, and the corrugated spur wheels 18 and 19, which heights are factors for determining the distance between the ink discharge surface 12*a* and each individual portion of the recording sheet P, are determined in such a manner that the time intervals Tk1 are longer than a minimum time interval Tm required for stably discharging an ink droplet from a nozzle 10 again after discharging an ink droplet from the same nozzle 10.

As described above, while the inkjet head 12 is accelerating, each individual time interval Ty of the ink discharge timing is shorter than the corresponding time interval Tk2. However, the inkjet head 12, while accelerating, moves at a lower velocity than when the inkjet head 12 moves at the constant velocity. Therefore, the time intervals Tk2 are longer than the time interval Tk1. Accordingly, each individual time interval Ty has a certain degree of length even though it is shorter than the corresponding time interval Tk2. Therefore, a problem is less likely to be caused that after a nozzle 10 discharges an ink droplet therefrom, a next ink discharge timing (moment) might come before the nozzle 10 is ready to stably discharge another ink droplet again, and thus the nozzle 10 is not able to adequately discharge an ink droplet.

Further, in consideration of the delay time ΔT2 depending on the height of the recording sheet P, as will be described below, there may be a situation where a time interval of the ink discharge timing is shortened in response to a change in the delay time ΔT2. However, as described above, each individual time interval Ty has a certain degree of length. Therefore, even though the time interval of the ink discharge timing is rendered shorter in response to the change in the delay time ΔT2, the aforementioned problem is less likely to be caused.

Meanwhile, while the inkjet head 12 is decelerating, as described above, each individual time interval Tz of the ink discharge timing is longer than the corresponding time interval Tk3. Further, the inkjet head 12, while decelerating, moves at a lower velocity than when the inkjet head 12 moves at the constant velocity. Therefore, the time intervals Tk3 are longer than the time interval Tk1. Accordingly, under an assumption that the delay time ΔT2 depending on the height of the recording sheet P is zero, it is certain that after a nozzle 10 discharges an ink droplet therefrom, a next ink discharge timing (moment) comes after the nozzle 10 is ready to stably discharge another ink droplet again.

Further, as described above, the time intervals Tk3 are longer than the time interval Tk1. Therefore, as described above, even though the time interval of the ink discharge timing is rendered shorter in response to a change in the delay time ΔT2, the aforementioned problem is less likely to be caused.

Additionally, in the embodiment, in the mountain portions Pm1 that have a greater amplitude than the amplitude of the other mountain portions Pm and the valley portions Pv1 that have a greater amplitude than the amplitude of the other valley portions Pv, the heights of the portions Pm1 and Pv1 greatly vary depending on the position in the scanning direction. Further, in the mountain portions Pm1 and the valley portions Pv1, the delay time ΔT2 greatly varies depending on the position in the scanning direction. Therefore, in the mountain portions Pm1 and the valley portions Pv1, when the time interval of the ink discharge timing is shortened in response to the change in the delay time ΔT2, the change in the time interval of the ink discharge timing is great.

However, when the inkjet head 12 is within the range R1 or R3 in which the inkjet head 12 discharges and lands ink droplets on the mountain portions Pm1 and the valley portions Pv1, as described above, the time intervals Tk2 and Tk3 are longer than the time interval Tk1. Therefore, when the time interval of the ink discharge timing is shortened, the change in the time interval of the ink discharge timing is somewhat great. Nonetheless, the time interval of the ink discharge timing is not shortened as much as when the inkjet head 12 moves at the constant velocity. Thus, the aforementioned problem is less likely to be caused.

Subsequently, an explanation will be provided about an ink discharge mode in the inkjet printer 1. In the inkjet printer 1, the control device 50 is configured to, in the printing operation, control the nozzles 10 to discharge ink therefrom in a selected one of a first discharge mode and a second discharge mode.

As described above, in the printing operation, the inkjet printer 1 discharges ink from the nozzles 10 while moving the inkjet head 12 together with the carriage 11 in the scanning direction. At this time, the recording sheet P is divided into an ascending area where the recording sheet P has a surface ascending in the moving direction of the inkjet head 12 and a descending area where the recording sheet P has a surface descending in the moving direction of the inkjet head 12.

Specifically, on the wave-shaped recording sheet P, areas S1 and areas S2 are alternately arranged along the scanning direction. Each area S1 has a bottom portion Pb at the left end thereof and an adjacent top portion Pt at the right end thereof. Meanwhile, each area S2 has a top portion Pt at the left end thereof and an adjacent bottom portion Pb at the right end thereof. When the inkjet head 12 moves rightward in FIGS. 7A to 7F, the area S1 is the ascending area, and the area S2 is the descending area. On the contrary, when the inkjet head 12 moves leftward in FIGS. 7A to 7F, the area S2 is the ascending area, and the area S1 is the descending area.

In the first discharge mode, as shown in FIG. 7E, regardless of whether the inkjet head 12 is moved rightward or leftward, the inkjet head 12 is controlled to discharge ink droplets onto both the areas S1 and the areas S2 (i.e., both the ascending areas and the descending areas). It is noted that each individual arrow in FIGS. 7E and 7F indicates the moving direction of the inkjet head 12 which discharges and lands ink droplets in a corresponding one of the areas S1 and S2 on the recording sheet P.

Meanwhile, in the second discharge mode, as shown in FIG. 7F, when the inkjet head 12 is moved rightward, the inkjet head 12 is controlled to discharge ink onto only the areas S1. When the inkjet head 12 is moved leftward, the inkjet head 12 is controlled to discharge ink onto only the areas S2. Namely, in the second discharge mode, the inkjet head 12 is controlled to discharge ink onto only the ascending areas.

Here, an explanation will be provided about a difference in the time interval of the ink discharge timing between when ink droplets are discharged onto the ascending areas and when ink droplets are discharged onto the descending areas.

In advance of the explanation on the difference in the time interval of the ink discharge timing, an explanation will be provided about a case where the recording sheet P has an even height. Under an assumption that the recording sheet P has an even height, while the inkjet head 12 is moving at the constant velocity, as shown in FIG. 10A, the inkjet head 12 is controlled to discharge ink droplets at ink discharge timings (moments) delayed by a constant delay time ΔT2*a*, which is determined depending on the height of the recording sheet P, with respect to the ink discharge timings (indicated by dashed lines) for discharging the ink droplets in the reference discharge positions. In this case, a time interval Tr of the ink discharge timing is equal to the time interval Tk1 for discharging the ink droplets in the reference discharge positions.

Meanwhile, when ink droplets are discharged to land on an ascending area, a portion of the recording sheet P on which a later-discharged ink droplet lands is closer to the ink discharge surface 12*a*. Therefore, under an assumption that the inkjet head 12 moves at the constant velocity, as shown in FIG. 10B, a later ink discharge timing (moment) is determined based on a longer delay time ΔT2 with respect to the reference discharge timing. FIG. 10B shows an example in which delay times ΔT2 for three successive ink discharge timings (moments) are represented as a delay time ΔT2*b*, a delay time ΔT2*c* (>ΔT2*b*), and a delay time ΔT2*d* (>ΔT2*c*), respectively, in an order from the earliest ink discharge timing (moment). In this case, each time interval Ti of the ink discharge timing is longer than the time interval Tr, which is equal to the time interval Tk1 and determined based on the constant delay time ΔT2*a*.

Meanwhile, when ink droplets are discharged to land on a descending area, a portion of the recording sheet P on which a later-discharged ink droplet lands is further away from the ink discharge surface 12*a*. Therefore, under the assumption that the inkjet head 12 moves at the constant velocity, as shown in FIG. 10C, a later ink discharge timing (moment) is determined based on a shorter delay time ΔT2 with respect to the reference discharge timing. FIG. 10C shows an example in which delay times ΔT2 for three successive ink discharge timings (moments) are represented as a delay time ΔT2*e*, a delay time ΔT2*f* (<ΔT2*e*), and a delay time ΔT2*g* (<ΔT2*f*), respectively, in an order from the earliest ink discharge timing (moment). In this case, each time interval Tj of the ink discharge timing is shorter than the time interval Tr, which is equal to the time interval Tk1 and determined based on the constant delay time ΔT2*a*.

Next, an explanation will be provided about a selection between the first discharge mode and the second discharge mode in the inkjet printer 1, with reference to FIG. 11. In the embodiment, the inkjet printer 1 is configured to select one of high-resolution printing and low-resolution printing, e.g., in response to image data of an image to be printed, under control by the control device 50. It is noted that the high-resolution printing is implemented with a shorter interval (distance) between adjacent ink landing positions, and the low-resolution printing is implemented with a longer interval (distance) between adjacent ink landing positions. In the high-resolution printing, the moving velocity of the inkjet head 12 within the range R2 is lower than that in the low-resolution printing. A process shown in FIG. 11 is launched when a print resolution is selected by a user's manual operation of the operation unit 6 or a PC (not shown) connected with the inkjet printer 1 in the printing operation or is selected automatically in response to the image data of the image to be printed.

Then, as shown in FIG. 11, when the high-resolution printing is selected (S101: Yes), the control device 50 selects the first discharge mode (S102). Meanwhile, when the low-resolution printing is selected (S101: No), the control device 50 selects the second discharge mode (S103).

In the inkjet printer 1 of the embodiment, as described above, the time interval Tk1 is generally longer than the minimum time interval Tm. Nonetheless, in the low-resolution printing, the moving velocity of the inkjet head 12 is higher than that in the high-resolution printing, and the time interval Tk1 is short.

Meanwhile, when ink droplets are discharged to land on an ascending area, as described above, the ink droplets are discharged from the nozzles 10 at the time intervals Ti longer than the time interval Tk1. Accordingly, in each of the high-resolution printing and the low-resolution printing, the aforementioned problem is less likely to be caused that after an ink droplet is discharged from a nozzle 10, a next ink discharge timing (moment) might come before the nozzle 10 is ready to stably discharge another ink droplet again.

On the contrary, when ink droplets are discharged to land on a descending area, as described above, the ink droplets are discharged from the nozzles 10 at the time intervals Tj shorter than the time interval Tk1. At this time, in the high-resolution printing, the time interval Tk1 is longer than when in the low-resolution printing. Hence, even though the time intervals Tj are somewhat shorter than the time interval Tk1, the aforementioned problem is less likely to be caused.

At this time, in the low-resolution printing, the time interval Tk1 is shorter than when in the high-resolution printing. Hence, the time intervals Tj shorter than the time interval Tk1 might be shorter than the minimum time interval Tm, and thus the aforementioned problem might be caused.

In the embodiment, as described above, in the high-resolution printing, the first discharge mode is selected in which the inkjet head 12 is controlled to discharge ink droplets onto both the ascending areas and the descending areas, regardless of whether the inkjet head 12 moves rightward or leftward. Meanwhile, in the low-resolution printing, the second discharge mode is selected in which the inkjet head 12 is controlled to discharge ink droplets onto only the ascending areas when the inkjet head 12 moves rightward and as well moves leftward. Thereby, it is possible to prevent the aforementioned problem that after an ink droplet is discharged from a nozzle 10, a next ink discharge timing (moment) might come before the nozzle 10 is ready to stably discharge another ink droplet again.

Hereinabove, the embodiment according to aspects of the present invention has been described. The present invention can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present invention. However, it should be recognized that the present invention can be practiced without reapportioning to the details specifically set forth. In other instances, well known processing structures have not been described in detail, in order not to unnecessarily obscure the present invention.

Only an exemplary embodiment of the present invention and but a few examples of their versatility are shown and described in the present disclosure. It is to be understood that the present invention is capable of use in various other combinations and environments and is capable of changes or modifications within the scope of the inventive concept as expressed herein. For example, the following modifications are possible. It is noted that, in the following modifications, explanations about the same configurations as exemplified in the aforementioned embodiment will be omitted.

[Modifications]

In the aforementioned embodiment, the selection between the first discharge mode and the second discharge mode is made depending on whether to perform the high-resolution printing or the low-resolution printing. However, the selection between the first discharge mode and the second discharge mode may be made in a different manner.

For instance, in the aforementioned embodiment, the delay times ΔT1 and ΔT2 are determined based on detection results of the encoder sensor 20. However, in advance of being actually determined in such a manner, the delay times ΔT1 and ΔT2 may be estimated based on factors such as the height of the ink discharge surface 12*a*, the heights of the mountain portions Pm and the valley portions Pv on the recording sheet P, the moving velocity of the inkjet head 12, and the ink discharge velocity for discharging ink droplets from the nozzles 10.

Then, each time interval between an ink discharge timing (moment) to discharge an ink droplet from a nozzle 10 and a next ink discharge timing (moment) to discharge another ink droplet from the nozzle 10 may be determined based on the estimated delay times ΔT1 and ΔT2. Further, the first discharge mode may be selected when all the determined time intervals are longer than the minimum time interval Tm. Meanwhile, the second mode may be selected when at least one of the determined time intervals is equal to or shorter than the minimum time interval Tm.

In the aforementioned embodiment, from a viewpoint of the time interval of the ink discharge timing, the first discharge mode is selected for the high-resolution printing, and the second discharge mode is selected for the low-resolution printing. However, the selection between the first discharge mode and the second discharge mode may be made from a different viewpoint.

For example, when an ink droplet is discharged to land on an ascending area, as shown in FIG. 12A, an angle α between a flying direction of the ink droplet and an extending direction of the ascending area on the recording sheet P in the scanning direction is close to 90 degrees. Therefore, a dot to be formed by the ink droplet landing on the ascending area is less likely to extend in the scanning direction. Meanwhile, when an ink droplet is discharged to land on a descending area, as shown in FIG. 12B, an angle β between a flying direction of the ink droplet and an extending direction of the descending area on the recording sheet P in the scanning direction is smaller than the angle α. Therefore, a dot to be formed by the ink droplet landing on the descending area is more likely to extend in the scanning direction than the dot on the ascending area. Namely, the ink droplet landing on the ascending area forms a more stable shape of dot on the recording sheet P than the ink droplet landing on the descending area.

Thus, for instance, in a modification according to aspects of the present invention, the second discharge mode may be selected for the high-resolution printing. In the modification, it takes a longer period of time for execution of the high-resolution printing than in the aforementioned embodiment. However, since ink droplets are discharged onto only the ascending areas, it is possible to stabilize the shapes of dots on the recording sheets P and improve the quality of a printed image. Meanwhile, in the low-resolution printing, when the time interval of the ink discharge timing is always longer than the minimum time interval Tm, the first discharge mode may be selected from a viewpoint of speed-up of the printing.

In the aforementioned embodiment, it is possible to switch between the first discharge mode and the second discharge mode. However, a specific one of the first and second discharge modes may be applied to all printing operations.

When an ink droplet is discharged to land on an ascending area, as shown in FIG. 12A, the angle α between the flying direction of the ink droplet and the extending direction of the ascending area on the recording sheet P in the scanning direction is close to 90 degrees. Therefore, the dot to be formed by the ink droplet landing on the ascending area is less likely to extend in the scanning direction. On the contrary, when an ink droplet is discharged to land on a descending area, as shown in FIG. 12B, the angle β between the flying direction of the ink droplet and the extending direction of the descending area on the recording sheet P in the scanning direction is smaller than the angle α. Therefore, a dot to be formed by the ink droplet landing on the descending area is more likely to extend in the scanning direction than the dot on the ascending area. Namely, the ink droplet landing on the ascending area forms a more stable shape of dot on the recording sheet P than the ink droplet landing on the descending area.

Thus, for instance, in a modification according to aspects of the present invention, the second discharge mode may always be applied to discharge ink droplets from the nozzles 10 in, without the selection between the first discharge mode and the second discharge mode. In the modification, it takes a longer period of time for execution of the high-resolution printing than in the aforementioned embodiment. Nonetheless, since ink droplets are discharged onto only the ascending areas, it is possible to stabilize the shapes of dots on the recording sheets P and improve the quality of a printed image.

In the aforementioned embodiment, the printable range Rp includes all the ranges R1, R2, and R3. However, for example, when printing is performed by discharging ink droplets from the nozzles 10 only in a specific one of the rightward movement and the leftward movement of the inkjet head 12, the printable range Rp may include only the range R2 and one of the ranges R2 and R3.

In this case, as described above, when the inkjet head 12 is within the deceleration range (while the inkjet head 12 is decelerating), the time intervals of the ink discharge timing are longer than when the inkjet head 12 is within the acceleration range (and the constant-velocity range). Accordingly, when it is required to select only one of the ranges R1 and R3 as a range to be included in the printable range Rp, it is advantageous to select a range corresponding to the deceleration range from the ranges R1 and R3.

In the aforementioned embodiment, the range R2 is provided in which the inkjet head 12 moves at the constant velocity. However, for instance, the inkjet head 12 may be configured to begin to decelerate immediately after accelerating up to a maximum velocity.

In the aforementioned embodiment, the outmost top portions Pt1 are higher than the other top portions Pt, and the outmost bottom portions Pb1 are lower than the other bottom portions Pb. However, all the top portions Pt (including the top portions Pt1) may have the same height. Further, all the bottom portions Pb (including the bottom portions Pb1) may have the same height.

In the aforementioned embodiment, an ink droplet is discharged from a nozzle 10 at an ink discharge timing (moment) delayed by the delay times ΔT1 and ΔT2 with respect to the reference discharge timing. However, unlike the aforementioned embodiment in which the ink discharge timing is determined based on the detection result of the encoder sensor 20, all the ink discharge timings (moments) may previously be determined before execution of a printing operation. In this modification, each ink discharge timing (moment) may be determined to be earlier than the reference discharge timing.

What is claimed is:

1. An inkjet printer comprising:

an inkjet head configured to discharge ink droplets from nozzles formed in an ink discharge surface thereof while reciprocating relative to a recording sheet along a scanning direction parallel to the ink discharge surface;

a wave shape holding mechanism configured to hold the recording sheet in a predetermined wave shape that has top portions of portions protruding in a first direction toward the ink discharge surface and bottom portions of portions recessed in a second direction opposite to the first direction, the top portions and the bottom portions alternately arranged along the scanning direction; and a control device configured to:

control the inkjet head to move along the scanning direction and discharge the ink droplets from the nozzles; and determine ink discharge moments to discharge the ink droplets from the nozzles while the inkjet head is moving within at least one of an acceleration range to accelerate the inkjet head and a deceleration range to decelerate the inkjet head, based on a distance between the ink discharge surface and the recording sheet held in the predetermined wave shape and a moving velocity of the inkjet head, by:

setting first ink discharge moments to discharge the ink droplets from the nozzles while inkjet head is moving within the acceleration range, based on an assumption that the distance between the ink discharge surface and the recording sheet is uniform in the scanning direction and identical to a reference distance between the ink discharge surface and a reference portion on the recording sheet, wherein a time interval between later successive two of the first ink discharge moments becomes shorter than a time interval between earlier successive two of the first ink discharge moments;

determining the ink discharge moments to discharge the ink droplets from the nozzles onto an ascending area of the recording sheet in the predetermined wave shape while the inkjet head is moving within the acceleration range, in such a manner that a time interval between later successive two of the ink discharge moments is longer than a time interval between corresponding successive two of the first ink discharge moments, by a larger time interval difference than a time interval between earlier successive two of the ink discharge moments;

determining the ink discharge moments to discharge the ink droplets from the nozzles onto a descending area of the recording sheet in the predetermined wave shape while the inkjet head is moving within the acceleration range, in such a manner that a time interval between later successive two of the ink discharge moments is shorter than a time interval between corresponding successive two of the first ink discharge moments, by a larger time interval difference than a time interval between earlier successive two of the ink discharge moments;

setting second ink discharge moments to discharge the ink droplets from the nozzles while inkjet head is moving within the deceleration range, based on the assumption that the distance between the ink discharge surface and the recording sheet is uniform in the scanning direction and identical to the reference distance between the ink discharge surface and the reference portion on the recording sheet, wherein a time interval between later successive two of the second ink discharge moments becomes longer than a time interval between earlier successive two of the second ink discharge moments;

determining the ink discharge moments to discharge the ink droplets from the nozzles onto an ascending area of the recording sheet in the predetermined wave shape while the inkjet head is moving within the deceleration range, in such a manner that a time interval between later successive two of the ink discharge moments is longer than a time interval between corresponding successive two of the second ink discharge moments, by a larger time interval difference than a time interval between earlier successive two of the ink discharge moments; and determining the ink discharge moments to discharge the ink droplets from the nozzles onto a descending area of the recording sheet in the predetermined wave shape while the inkjet head is moving within the deceleration range, in such a manner that a time interval between later successive two of the ink discharge moments is shorter than a time interval between corresponding successive two of the second ink discharge moments, by a larger time interval difference than a time interval between earlier successive two of the ink discharge moments.

2. The inkjet printer according to claim 1, wherein the control device is further configured to:

determine, for each ink discharge moment, a delay time with respect to a reference discharge moment determined based on a reference distance between the ink discharge surface and the recording sheet, based on the distance between the ink discharge surface and the recording sheet held in the predetermined wave shape and the moving velocity of the inkjet head; and determine each ink discharge moment while the inkjet head is moving within the at least one of the acceleration range and the deceleration range, as a moment later than the reference discharge moment by the determined delay time.

3. The inkjet printer according to claim 1, wherein the control device is further configured to determine the ink discharge moments based on information as to the predetermined wave shape of the recording sheet, by:

determining a reference discharge moment for each individual ink discharge moment, based on an assumption that the distance between the ink discharge surface and the recording sheet is uniform in the scanning direction and identical to a reference distance between the ink discharge surface and a reference bottom portion of the bottom portions on the recording sheet; and determining a delay time, by which each individual ink discharge moment is determined as a moment delayed with respect to the reference discharge moment, based on a difference between the reference distance and an individual distance between the inkjet surface and a portion of the recording sheet that corresponds to a position of the inkjet head in the scanning direction, the individual distance acquired from the information as to the predetermined wave shape of the recording sheet.

4. The inkjet printer according to claim 1, wherein the control device is further configured to determine the ink discharge moments to discharge the ink droplets from the nozzles while the inkjet head is moving within a predetermined printable range comprising the deceleration range to decelerate the inkjet head.

5. The inkjet printer according to claim 1, wherein the control device is further configured to:

control the inkjet head to move along the scanning direction by accelerating the inkjet head up to a predetermined velocity, then keeping the inkjet head moving at the predetermined velocity, and afterward decelerating the inkjet head; and determine the ink discharge moments to discharge the ink droplets from the nozzles while the inkjet head is moving within a predetermined printable range comprising a constant-velocity range to move the inkjet head at the predetermined velocity and the at least one of the acceleration range and the deceleration range.

6. The inkjet printer according to claim 5, wherein the control device is further configured to:

control the inkjet head to discharge an ink droplet while moving within the at least one of the acceleration range and the deceleration range in such a manner that the ink droplet lands in an acceleration-deceleration print area on the recording sheet; and control the inkjet head to discharge an ink droplet while moving within the constant-velocity range in such a manner that the ink droplet lands in a constant-velocity print area on the recording sheet, the constant-velocity print area being adjacent to the acceleration-deceleration print area in the scanning direction, and wherein the wave shape holding mechanism is further configured to hold the recording sheet in the predetermined wave shape that has at least one, of a large-amplitude top portion and a large-amplitude bottom portion, formed in the acceleration-deceleration print area with an amplitude greater than amplitudes of other portions in the constant-velocity print area.

7. The inkjet printer according to claim 6, wherein the predetermined printable range comprises the acceleration range, the constant-velocity range, and the deceleration range, and wherein the constant-velocity print area is disposed between two of the acceleration-deceleration print area in the scanning direction on the recording sheet, the two of the acceleration-deceleration print area corresponding to the acceleration range and the deceleration range, respectively.

8. The inkjet printer according to claim 1, wherein the control device is further configured to:

when moving the inkjet head toward a first side along the scanning direction, control the inkjet head to discharge ink droplets from the nozzles into first areas on the recording sheet held in the predetermined wave shape without discharging any ink droplet into second areas on the recording sheet, each first area having an ascending slope in the first moving direction, each second area having a descending slope in the first moving direction; and when moving the inkjet head toward a second side opposite to the first side along the scanning direction, control the inkjet head to discharge ink droplets from the nozzles into the second areas on the recording sheet.

9. The inkjet printer according to claim 8, wherein each first area has a corresponding bottom portion at the second side thereof along the scanning direction and an adjacent top portion at the first side thereof along the scanning direction, and wherein each second area has a corresponding top portion at the second side thereof along the scanning direction and an adjacent bottom portion at the first side thereof along the scanning direction.

10. The inkjet printer according to claim 8, wherein the control device is further configured to selectively execute one of:

a first discharge mode in which the control device controls the inkjet head to discharge ink droplets from the nozzles into both the first areas and the second areas on the recording sheet when moving the inkjet head toward the first side along the scanning direction; and a second discharge mode in which the control device controls the inkjet head to discharge ink droplets from the nozzles into the first areas on the recording sheet when moving the inkjet head in the first moving direction along the scanning direction, and controls the inkjet head to discharge ink droplets from the nozzles into the second areas on the recording sheet when moving the inkjet head toward the second side along the scanning direction.

11. The inkjet printer according to claim 10, wherein the control device is further configured to select the second discharge mode when a time interval between two successive ones of the ink discharge moments is shorter than a predetermined period of time.

12. The inkjet printer according to claim 1, wherein the control device is further configured to determine the ink discharge moments to discharge the ink droplets from the nozzles onto a descending area of the recording sheet in the predetermined wave shape, in such a manner that a time interval between any successive two of the ink discharge moments is longer than a time interval between a moment at which a nozzle discharges an ink droplet therefrom and a moment at which the nozzle becomes ready to stably discharge another ink droplet again.

13. An inkjet printer comprising:

an inkjet head configured to discharge ink droplets from nozzles formed in an ink discharge surface thereof while reciprocating relative to a recording sheet along a scanning direction parallel to the ink discharge surface;

a wave shape holding mechanism configured to hold the recording sheet in a predetermined wave shape that has top portions of portions protruding in a first direction toward the ink discharge surface and bottom portions of portions recessed in a second direction opposite to the first direction, the top portions and the bottom portions alternately arranged along the scanning direction; and a control device configured to:

control the inkjet head to move along the scanning direction and discharge the ink droplets from the nozzles; and determine ink discharge timing to discharge an ink droplet from the nozzles while the inkjet head is moving within a predetermined printable range comprising at least one of an acceleration range to accelerate the inkjet head and a deceleration range to decelerate the inkjet head, based on a moving velocity of the inkjet head and a distance, depending on a position of the inkjet head in the scanning direction, between the ink discharge surface and the recording sheet held in the predetermined wave shape, by:

setting first ink discharge moments to discharge the ink droplets from the nozzles while inkjet head is moving within the acceleration range, based on an assumption that the distance between the ink discharge surface and the recording sheet is uniform in the scanning direction and identical to a reference distance between the ink discharge surface and a reference portion on the recording sheet, wherein a time interval between later successive two of the first ink discharge moments becomes shorter than a time interval between earlier successive two of the first ink discharge moments;

determining the ink discharge moments to discharge the ink droplets from the nozzles onto an ascending area of the recording sheet in the predetermined wave shape while the inkjet head is moving within the acceleration range, in such a manner that a time interval between later successive two of the ink discharge moments is longer than a time interval between corresponding successive two of the first ink discharge moments, by a larger time interval difference than a time interval between earlier successive two of the ink discharge moments;

determining the ink discharge moments to discharge the ink droplets from the nozzles onto a descending area of the recording sheet in the predetermined wave shape while the inkjet head is moving within the acceleration range, in such a manner that a time interval between later successive two of the ink discharge moments is shorter than a time interval between corresponding successive two of the first ink discharge moments, by a larger time interval difference than a time interval between earlier successive two of the ink discharge moments;

setting second ink discharge moments to discharge the ink droplets from the nozzles while inkjet head is moving within the deceleration range, based on the assumption that the distance between the ink discharge surface and the recording sheet is uniform in the scanning direction and identical to the reference distance between the ink discharge surface and the reference portion on the recording sheet, wherein a time interval between later successive two of the second ink discharge moments becomes longer than a time interval between earlier successive two of the second ink discharge moments;

determining the ink discharge moments to discharge the ink droplets from the nozzles onto an ascending area of the recording sheet in the predetermined wave shape while the inkjet head is moving within the deceleration range, in such a manner that a time interval between later successive two of the ink discharge moments is longer than a time interval between corresponding successive two of the second ink discharge moments, by a larger time interval difference than a time interval between earlier successive two of the ink discharge moments; and determining the ink discharge moments to discharge the ink droplets from the nozzles onto a descending area of the recording sheet in the predetermined wave shape while the inkjet head is moving within the deceleration range, in such a manner that a time interval between later successive two of the ink discharge moments is shorter than a time interval between corresponding successive two of the second ink discharge moments, by a larger time interval difference than a time interval between earlier successive two of the ink discharge moments.

14. An inkjet printer comprising:

an inkjet head configured to discharge ink droplets from nozzles formed in an ink discharge surface thereof while reciprocating relative to a recording sheet along a scanning direction parallel to the ink discharge surface;

a wave shape holding mechanism configured to hold the recording sheet in a predetermined wave shape that has top portions of portions protruding in a first direction toward the ink discharge surface and bottom portions of portions recessed in a second direction opposite to the first direction, the top portions and the bottom portions alternately arranged along the scanning direction; and a control device configured to:

control the inkjet head to move along the scanning direction and discharge the ink droplets from the nozzles; and determine ink discharge moments to discharge the ink droplets from the nozzles while the inkjet head is moving within at least one of an acceleration range to accelerate the inkjet head and a deceleration range to decelerate the inkjet head, based on a distance between the ink discharge surface and the recording sheet held in the predetermined wave shape and a moving velocity of the inkjet head, wherein the control device is further configured to:

when moving the inkjet head toward a first side along the scanning direction, control the inkjet head to discharge ink droplets from the nozzles into first areas on the recording sheet held in the predetermined wave shape without discharging any ink droplet into second areas on the recording sheet, each first area having an ascending slope in the first moving direction, each second area having a descending slope in the first moving direction; and when moving the inkjet head toward a second side opposite to the first side along the scanning direction, control the inkjet head to discharge ink droplets from the nozzles into the second areas on the recording sheet.

15. The inkjet printer according to claim 14, wherein each first area has a corresponding bottom portion at the second side thereof along the scanning direction and an adjacent top portion at the first side thereof along the scanning direction, and wherein each second area has a corresponding top portion at the second side thereof along the scanning direction and an adjacent bottom portion at the first side thereof along the scanning direction.

16. The inkjet printer according to claim 14, wherein the control device is further configured to selectively execute one of:

a first discharge mode in which the control device controls the inkjet head to discharge ink droplets from the nozzles into both the first areas and the second areas on the recording sheet when moving the inkjet head toward the first side along the scanning direction; and a second discharge mode in which the control device controls the inkjet head to discharge ink droplets from the nozzles into the first areas on the recording sheet when moving the inkjet head in the first moving direction along the scanning direction, and controls the inkjet head to discharge ink droplets from the nozzles into the second areas on the recording sheet when moving the inkjet head toward the second side along the scanning direction.

17. The inkjet printer according to claim 16, wherein the control device is further configured to select the second discharge mode when a time interval between two successive ones of the ink discharge moments is shorter than a predetermined period of time.

* * * * *